US009782015B2

(12) United States Patent
Zanki et al.

(10) Patent No.: US 9,782,015 B2
(45) Date of Patent: Oct. 10, 2017

(54) SUPPORT APPARATUS

(71) Applicants: Logan Zanki, North Plainfield, NJ (US); Kathleen Zanki, North Plainfield, NJ (US)

(72) Inventors: Logan Zanki, North Plainfield, NJ (US); Kathleen Zanki, North Plainfield, NJ (US)

( * ) Notice: Subject to any disclaimer, the term of this patent is extended or adjusted under 35 U.S.C. 154(b) by 0 days.

(21) Appl. No.: 15/096,936

(22) Filed: Apr. 12, 2016

(65) Prior Publication Data

US 2017/0071357 A1 Mar. 16, 2017

Related U.S. Application Data

(63) Continuation of application No. 29/539,413, filed on Sep. 14, 2015, and a continuation-in-part of application No. 29/548,298, filed on Dec. 11, 2015, now Pat. No. Des. 793,123, and a continuation-in-part of application No. 29/555,110, filed on Feb. 18, 2016.

(51) Int. Cl.
*A47C 20/02* (2006.01)

(52) U.S. Cl.
CPC ..... *A47C 20/025* (2013.01)

(58) Field of Classification Search
CPC ..... A47C 20/025; A47C 27/10
USPC ..... 5/631
See application file for complete search history.

(56) References Cited

U.S. PATENT DOCUMENTS

| | | | | |
|---|---|---|---|---|
| 2,089,584 A | | 8/1937 | Pellegrini | |
| 3,118,152 A | | 1/1964 | Talley, Jr. | |
| 3,287,747 A | | 11/1966 | Ellsorth | |
| 3,378,862 A | | 4/1968 | Skinner | |
| 3,988,793 A | | 11/1976 | Abitbol | |
| 4,021,872 A | | 5/1977 | Powell | |
| 4,051,566 A | | 10/1977 | Esquivel | |
| 4,054,960 A | | 10/1977 | Pettit et al. | |
| 4,489,452 A | | 12/1984 | Lickert | |
| 4,508,384 A | | 4/1985 | Castelot et al. | |
| 4,737,999 A | * | 4/1988 | Halverson | A47C 20/025 5/710 |
| 4,819,287 A | | 4/1989 | Halverson | |
| 4,944,059 A | * | 7/1990 | Wall | A47C 20/025 5/631 |
| D311,838 S | | 11/1990 | Dillon | |
| 5,029,349 A | | 7/1991 | Hamilton | |

(Continued)

FOREIGN PATENT DOCUMENTS

| | | |
|---|---|---|
| GB | 2425468 | 11/2006 |
| GB | 2439916 | 1/2008 |
| GB | 2471467 | 1/2011 |

OTHER PUBLICATIONS http://www.thebellybed.com.au. Accessed on Aug. 14, 2015.

(Continued)

*Primary Examiner* — David E Sosnowski
*Assistant Examiner* — Myles Throop
(74) *Attorney, Agent, or Firm* — Gearhart Law LLC

(57) ABSTRACT

The present disclosure provides a support for people with distended abdominal areas such as, but not limited to, individuals who are overweight or pregnant. Further, the support apparatus may be used by people suffering from back problems, as the raised area surrounding the opening in the support raises the pelvis and is intended to remove pressure from the lumbar spine and other areas of a person's midsection.

12 Claims, 37 Drawing Sheets

(56) References Cited

U.S. PATENT DOCUMENTS

| | | | | |
|---|---|---|---|---|
| 5,086,529 | A | 2/1992 | Degroot | |
| 5,127,119 | A | 7/1992 | Rogers | |
| 5,185,897 | A | 2/1993 | Van Laanen | |
| D333,938 | S | 3/1993 | Watson et al. | |
| D335,999 | S | 6/1993 | Van Driessche | |
| 5,237,712 | A | 8/1993 | Ramsay | |
| D341,725 | S | 11/1993 | Piper | |
| D342,409 | S | 12/1993 | Gambin | |
| D343,303 | S | 1/1994 | DiGregorio | |
| 5,303,435 | A * | 4/1994 | Haar | A47C 27/084 5/413 AM |
| D350,586 | S | 9/1994 | Francis | |
| 5,369,824 | A | 12/1994 | Powell | |
| 5,400,449 | A | 3/1995 | Satto | |
| D357,538 | S | 4/1995 | Sockwell | |
| 5,412,824 | A * | 5/1995 | Emerson | A47C 20/025 5/631 |
| 5,425,147 | A | 6/1995 | Supplee et al. | |
| 5,438,715 | A | 8/1995 | Jackman | |
| 5,504,953 | A | 4/1996 | Singer-Leyton et al. | |
| 5,652,981 | A | 8/1997 | Singer-Leyton et al. | |
| 5,679,040 | A | 10/1997 | Bianchi-Holm | |
| D392,145 | S | 3/1998 | Thurston | |
| D396,771 | S | 8/1998 | Iannuzzi | |
| 5,819,348 | A | 10/1998 | Ryan | |
| D403,194 | S | 12/1998 | Thurston | |
| 5,890,246 | A | 4/1999 | Davis | |
| D411,933 | S | 7/1999 | Bernstein | |
| 6,044,505 | A | 4/2000 | Friedman | |
| 6,185,768 | B1 | 2/2001 | Schlechter | |
| 6,233,768 | B1 | 5/2001 | Harding | |
| 6,295,668 | B1 | 10/2001 | Nation | |
| 6,408,468 | B1 * | 6/2002 | Comfort | A47G 9/10 5/498 |
| 6,408,470 | B1 | 6/2002 | Powers | |
| 6,581,229 | B2 | 6/2003 | Bernstein | |
| 6,823,547 | B1 | 11/2004 | Harding et al. | |
| 6,857,145 | B1 | 2/2005 | Sikes | |
| 7,065,816 | B2 | 6/2006 | McGettigan | |
| 7,065,817 | B2 | 6/2006 | Shield | |
| 7,127,764 | B1 | 10/2006 | Harding et al. | |
| 7,266,852 | B2 | 9/2007 | Davis | |
| 8,303,361 | B2 | 11/2012 | Green | |
| 8,656,541 | B2 | 2/2014 | Muollo | |
| 2005/0188465 | A1 | 9/2005 | Fahey | |
| 2006/0096034 | A1 | 5/2006 | Tucci | |
| 2009/0100601 | A1 | 4/2009 | Battaglia | |
| 2010/0125951 | A1 * | 5/2010 | Stefano | A61G 9/003 5/604 |
| 2013/0283526 | A1 | 10/2013 | Gagliardi | |
| 2014/0130262 | A1 * | 5/2014 | Marcik | A47C 21/022 5/692 |

OTHER PUBLICATIONS http://www.holo-lilo.com. Accessed on Aug. 14, 2015.
http://www.massagewarehouse.com/products/earthlite-pregnancy-cushion/. Accessed on Aug. 14, 2015.

* cited by examiner

SUPPORT APPARATUS

CLAIM OF PRIORITY

This application claims priority to U.S. application Ser. No. 29/539,413 filed on Sep. 14, 2015, U.S. application Ser. No. 29/548,298 filed on Dec. 11, 2015, and U.S. application Ser. No. 29/555,110 filed on Feb. 18, 2016, the contents of all of which are herein fully incorporated by reference in its entirety.

FIELD OF THE EMBODIMENTS

The field of the embodiments of the present invention relate to support apparatus for people with distended abdominal areas, such as but not limited to, individuals who are overweight or pregnant. Further, the support apparatus may be used by people with back problems, as the raised area surrounding the opening in the support apparatus raises a user's pelvis and is intended to remove pressure from the lumbar spine and other areas of a person's midsection.

BACKGROUND OF THE EMBODIMENTS

In the course of a pregnancy, women typically endure considerable discomfort, especially during the later stages of the pregnancy, and frequently suffer potentially serious physical impairments throughout their pregnancies. Further, some of the same maladies afflict those with particular medical conditions or those who may be obese.

As a fetus develops, it grows in size and weight thereby increasing the burden borne by the woman carrying the fetus. As the fetus continues to grow, it displaces certain organs and tissues within the woman's abdomen thereby stretching or distending certain muscles, compressing other muscles, and adding a notable amount of weight that the woman must carry. This, in turn, can have dramatic effects on the woman's posture, balance, and general comfort.

One of the most common and most difficult maladies to correct is lower back pain in expected mothers caused by the ever increasing size and weight of the fetus. As the fetus grows, it moves to project or distend forwardly within the woman's abdomen causing a weight imbalance. The woman must then attempt to "correct" this imbalance by contorting her upper torso back and her lower torso and pelvis forward thereby repositioning her center of gravity. Such a gross adjustment of the woman's posture results in the adverse distortion of her spine and notably changes in the distribution of weight and forces throughout the whole of her body, particularly in and about the pelvic region and lower lumbar region of her back.

In addition to the above, the presence of the growing fetus often exerts weight and pressures within the woman's abdomen that interferes with or obstructs the normal operation and function of her body. For example, the presence of a fetus usually exerts pressure on various nerves causing tingling, pain, or discomfort, pressure on blood vessels causing decreases in circulation, and potentially pressure on other organs that may results in impaired functioning of the organs.

For years, one of the most common pieces of advice and treatment for a woman suffering from the bodily effects of childbearing has been to stay off one's feet or be relegated to "bed rest." Both of such directives are intended to alleviate stresses on the lower back. However, such rest may further promote a decrease in stress and lowering of blood pressure. Further, bed rest may also provide an increase in blood flow to the placenta.

Efforts to solve the aforementioned problems have been met with tepid results. Some have attempted to provide various "wedge-shaped" cushions that are intended to be strategically placed in with and about the pregnant woman's body. Such cushions have proven to be no more effective than are common pillows positioned about a pregnant woman's body in a desired and comforting manner.

Yet other efforts have been associated with forming openings in mattresses and other horizontal body supports on which pregnant women can lie, face down, with their abdominal area positioned in the opening. Such efforts, however, have commonly had the effect to induce the women's bodies to drop down or "sag" into and through the openings, causing further bending of the woman's back and exacerbating those pains and discomfort that the woman experiences.

Thus, there is a need for a device that enables not only relief when a pregnant woman, or other afflicted individual, lies down but further targets the lower back in an effort to relieve the pains and stress caused by the weight carried. The present invention and its embodiments meets and exceeds these objectives.

Review of Related Technology:

U.S. Pat. No. 6,044,505 pertains to a pillow for pregnant, over weight, back-pain suffering, sleep apnea suffering, and sciatica suffering persons lying in a prone position. The pillow has an aperture extending through it, and is sized for receipt of a portion of the abdomen of the user. The aperture is defined by at least first, second, and third support structures, and is of a substantially uniform thickness. The first support structure extends substantially traversely across the lower-chest and upper-abdominal regions of the user, the second support structure extends along a first side-abdominal region of the user to end proximate to the person's pelvic region, and the third support structure extends along a second side-abdominal region of the user to also end proximate to the pelvic region of the user.

U.S. Pat. No. 4,944,059 pertains to a prenatal body support upon which a pregnant woman lies, face down, and that functions to remove the weight and pressure of a fetus within her abdomen from within her pelvic cavity and adjacent her spine and that relieves stresses imposed on her pelvis and spine caused by the weight and size of the fetus. The support comprises a soft, compressible and resilient body with front and rear ends, laterally spaced sides, a bottom surface and a top body supporting surface. The top body supporting surface has a high rear pelvis support portion extending longitudinal and transverse the rear end portion of the body, a pair of laterally spaced abdomen support portions extending longitudinally forward from the pelvic support portion, a longitudinally and transversely extending downwardly and forwardly inclined chest support portion forward of the abdomen support portions, a low forward longitudinally and transversely extending head support portion at the front end of the body and a central abdomen receiving recess opening upwardly between the abdomen support portions and between the pelvic and chest support portions of the top surface.

Various devices and methodologies are known in the art. However, their structure and means of operation are substantially different from the present disclosure. The other inventions also fail to solve all the problems taught by the present disclosure. The present invention and its embodiments provides a comfortable apparatus that is configured to alleviate stresses placed on the body by being pregnant, overweight, or suffering pain from similar maladies. At least one embodiment of this invention is presented in the drawings below and will be described in more detail herein.

SUMMARY OF THE EMBODIMENTS

In general, the present invention and its embodiments relate to support apparatuses for people with distended abdominal areas such as but not limited to individuals who are overweight or pregnant.

The embodiments are generally shaped to receive a user thereon. The shape may vary and, in some embodiments, may be manipulated by the user. The apparatus may be inflatable or may be of a solid construct such as foam, rubber, cloth, and the like. A covering comprising a padding, coloring, image, etc. may be disposed over the apparatus to provide enhanced comfort and aesthetic appeal.

In a central area or portion of the apparatus there is an opening shaped to receive a portion of a body of a user therethrough. It is intended this opening will receive an abdomen of a user. This may be particularly beneficial in the event of a pregnancy, where the distended abdominal area may be inserted into the opening to provide relief to the pregnant woman from the rigors placed on her body by the pregnancy.

As noted above, the apparatus may be inflatable. Not only does this provide comfort to the user, but also enables customization for each user. For example, the apparatus can be inflated or deflated to provide a particular "firmness" or "softness" to the user. Additionally, there may be multiple chambers contained within the apparatus thereby allowing such customization to be relegated to a particular area of the apparatus. For example, the area surrounding the opening may be more inflated than the body of the apparatus thereby allowing the surrounding area to become more raised and firm. This may provide for increased lift in the pelvic area while still providing a soft, yet cushioned fell to the remainder of the apparatus.

The apparatus generally has a shape that is intended to relieve the pressures placed on the human body by those that may be overweight or pregnant or suffer from another ailment for which similar relief may be sought. In some embodiments, the area surrounding the abdominal opening is raised above the top surface of the apparatus. In some embodiments, the top surface is generally flat and substantially parallel to the bottom surface, whereas in other embodiments the top surface is graded to slope away from the abdominal opening. This "sloping" form further allows for an arching the body to be made thereby alleviating stresses associated with the lower lumbar region of the spine, as well as tilting the pelvis in a way as to relief stresses placed on it.

In one embodiment of the present invention there is a support apparatus comprising a top surface, a bottom surface, and at least one side surface forming an inflatable chamber; an abdominal opening extending from the top surface to the bottom surface, wherein the abdominal opening is surrounded by a second inflatable chamber, wherein the second inflatable chamber has a height greater than that of the top surface; wherein the top surface forms a head receiving area and a leg receiving area; wherein the head receiving area is substantially parallel with the bottom surface, and wherein the leg receiving area is graded such that a distance between the top surface and the bottom surface is greatest near the abdominal opening and narrowest near a terminal end of the leg receiving area; and wherein the top surface and the bottom surface have a plurality of ridges longitudinally disposed thereon.

In another embodiment of the present invention there is a support apparatus comprising a top surface, a bottom surface, and at least one side surface forming an inflatable chamber; an abdominal opening extending from the top surface to the bottom surface, wherein the abdominal opening is surrounded by a second inflatable chamber, wherein the second inflatable chamber has a height greater than that of the top surface; wherein the top surface forms a head receiving area and a leg receiving area; wherein the head receiving area and leg receiving area is substantially parallel with the bottom surface; and wherein the top surface and the bottom surface have a plurality of ridges longitudinally disposed thereon.

In general, the present invention succeeds in conferring the following, and others not mentioned, benefits and objectives.

It is an object of the present invention to provide a support apparatus that is intended to be used by people with pain and stress placed on the lack, pelvis, and/or abdominal area.

It is an object of the present invention to provide a support apparatus that may be utilized by overweight or pregnant individuals.

It is an object of the present invention to provide a support apparatus that may be customized for a particular user's needs.

It is an object of the present invention to provide a support apparatus that enables an overweight or pregnant person to comfortably lay in a prone position.

It is an object of the present invention to provide a support apparatus that causes a user's back to arch upwards.

It is an object of the present invention to provide a support apparatus that is easily used and readily stored when not in use.

It is an object of the present invention to provide a support apparatus that is durable and lightweight.

It is an object of the present invention to provide a support apparatus that may be used by both men and women.

It is an object of the present invention to provide a support apparatus that is of varying shapes and sizes to accommodate a user's needs.

It is an object of the present invention to provide a support apparatus that provides an aesthetically pleasing apparatus.

It is an object of the present invention to provide a support apparatus that may be positioned on a variety of terrains.

DESCRIPTION OF THE PREFERRED EMBODIMENTS

Figure 1:
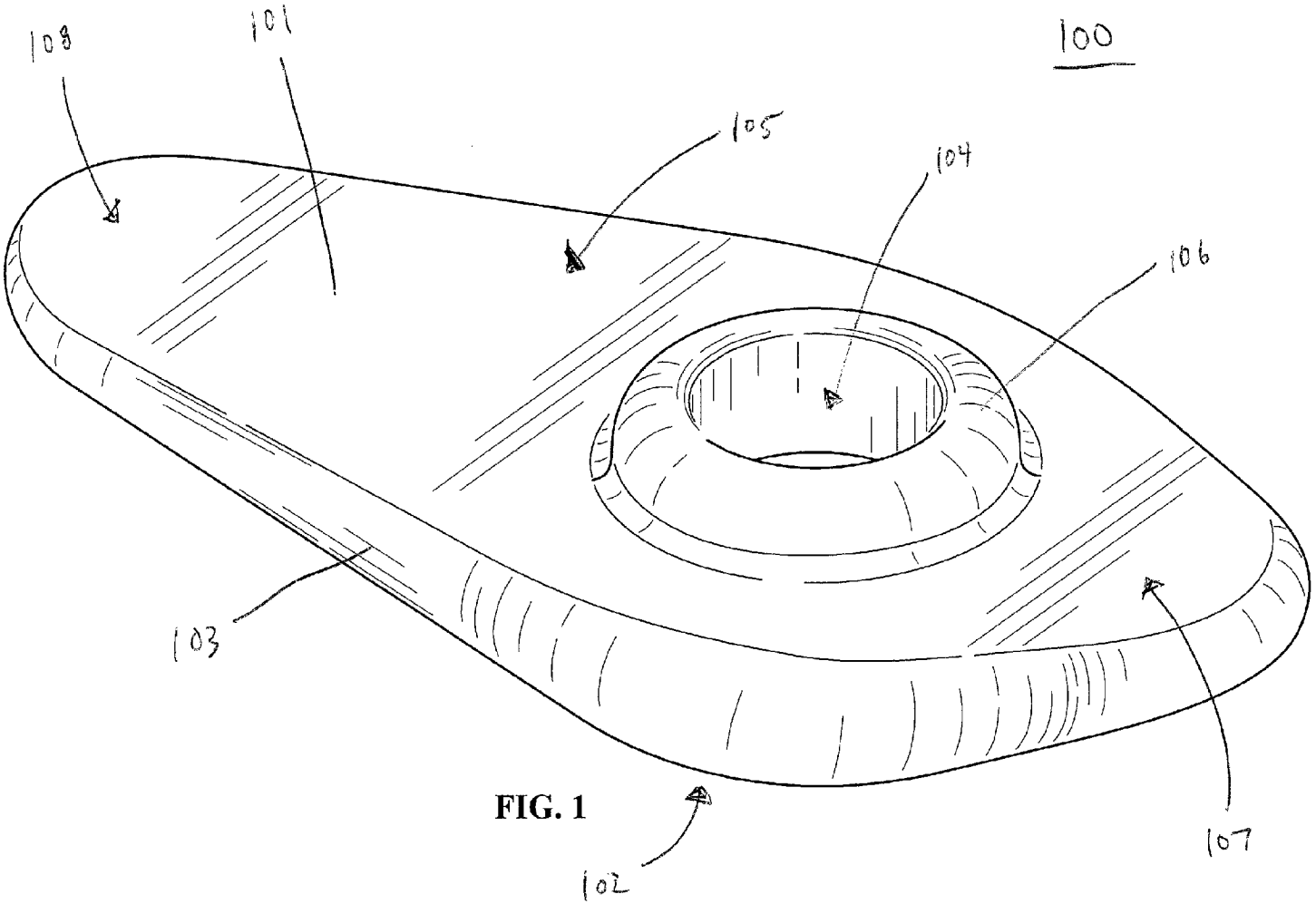
FIG. 1 is a perspective view of a first embodiment of the present invention.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

Referring now to FIGS. 1-8, there is a first embodiment of a support apparatus. The support apparatus 100 generally comprises a top surface 101, a side surface 103, a bottom surface 102, an abdominal opening 104, a first chamber 105, a second chamber 106, a head receiving area 107, and a leg receiving area 108.

The support apparatus 100 preferably comprises an inflatable body comprising at least a first chamber 105 and a second chamber 106. In other embodiments there may be more or fewer chambers arranged to provide customized levels of comfort (based on fill level, material, etc.) to a user. Each of the inflatable chambers may be accessed through traditional fill valves or nozzles. In some embodiments, there may be dedicated nozzles or valves for use with a particular pump-like apparatus. In yet other embodiments, the support apparatus 100 may be self-inflating or expanding.

The first chamber 105 may comprise a substantial portion of the main body of the support apparatus 100 or may be broken up into smaller individual chambers configured in an ergonomic pattern. The second chamber 106 may surround an opening or abdominal opening 104 located in a portion of the support apparatus 100. The abdominal opening 104 is intended and sized to receive an abdomen of a user therethrough. The abdominal opening 104 provides an area for a distended abdomen belonging to, for example, a pregnant or overweight individual. The second chamber 106 is raised or protrudes above the top surface 101 of the support apparatus 100 when inflated. In other embodiments, the second chamber 106 is not inflatable and is in a fixed position.

Figure 2:
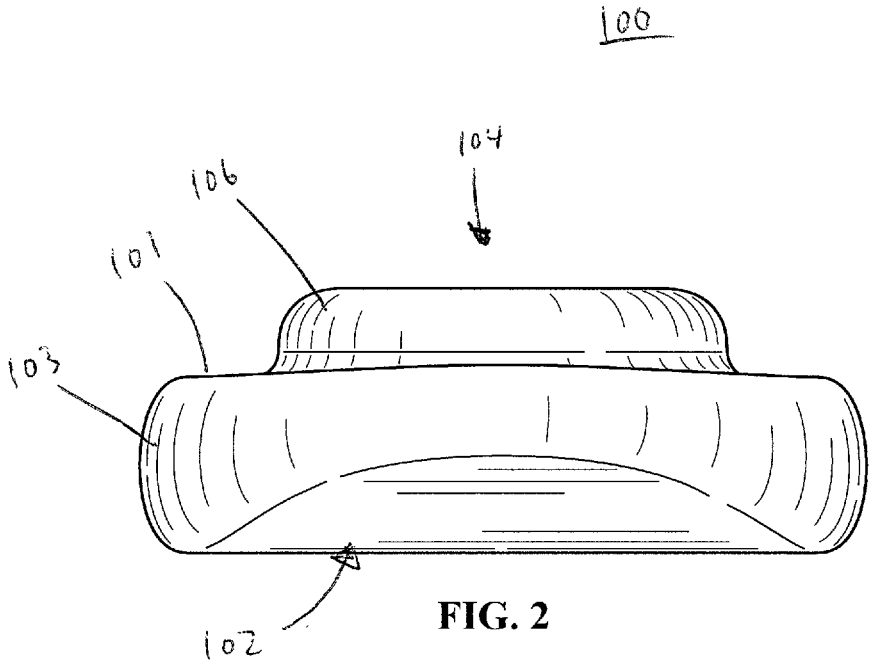
FIG. 2 is a front view of a first embodiment of the present invention.
Figure 3:
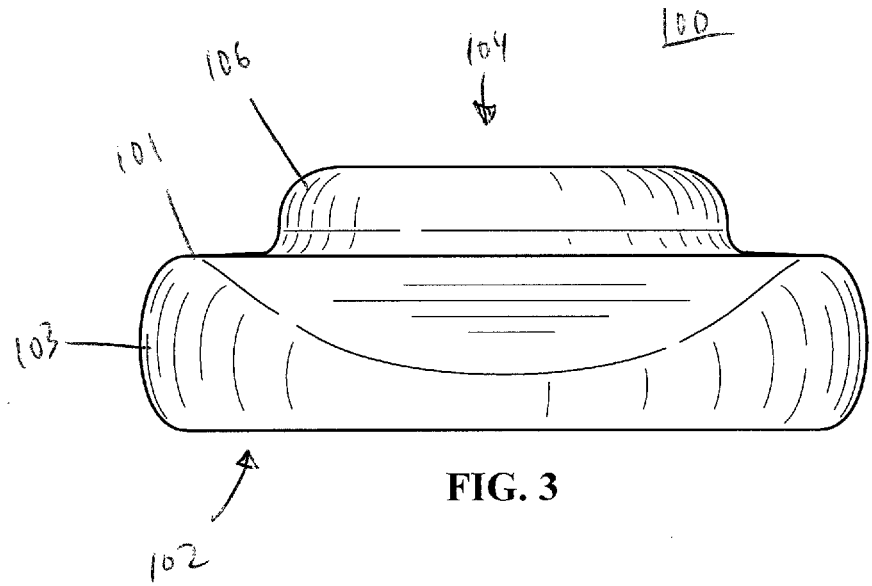
FIG. 3 is a back view of a first embodiment of the present invention.

When the second chamber 106 is filled with a gas or otherwise extended above the top surface 101, as shown in FIGS. 2-3, support may be provided to the user as the user places their abdominal area into the abdominal opening 104.

This support positions a user's hips slightly above their head and legs or upper torso and lower body.

The top surface 101 may comprise a head receiving area 107 and a leg receiving area 108. Each area is intended to receive the head and legs of the user in the respective area. However, some users may find it more practical to use the support apparatus 100 in other manners.

Figure 4:
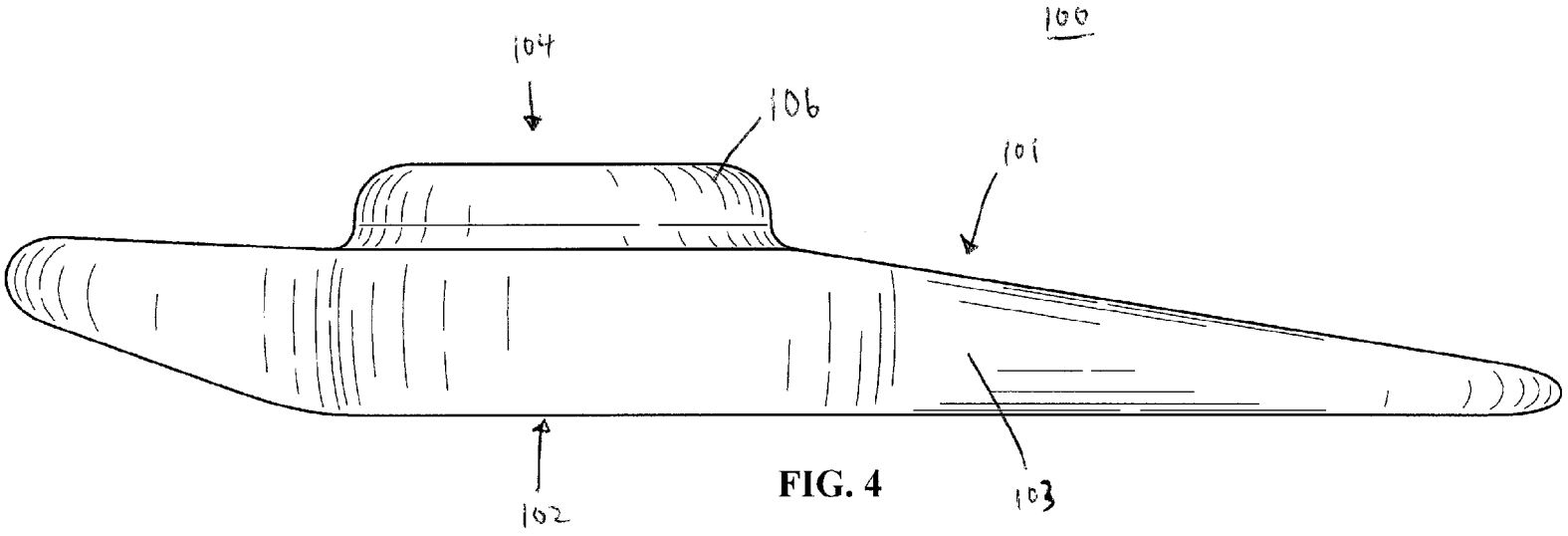
FIG. 4 is a side view of a first embodiment of the present invention.
Figure 5:
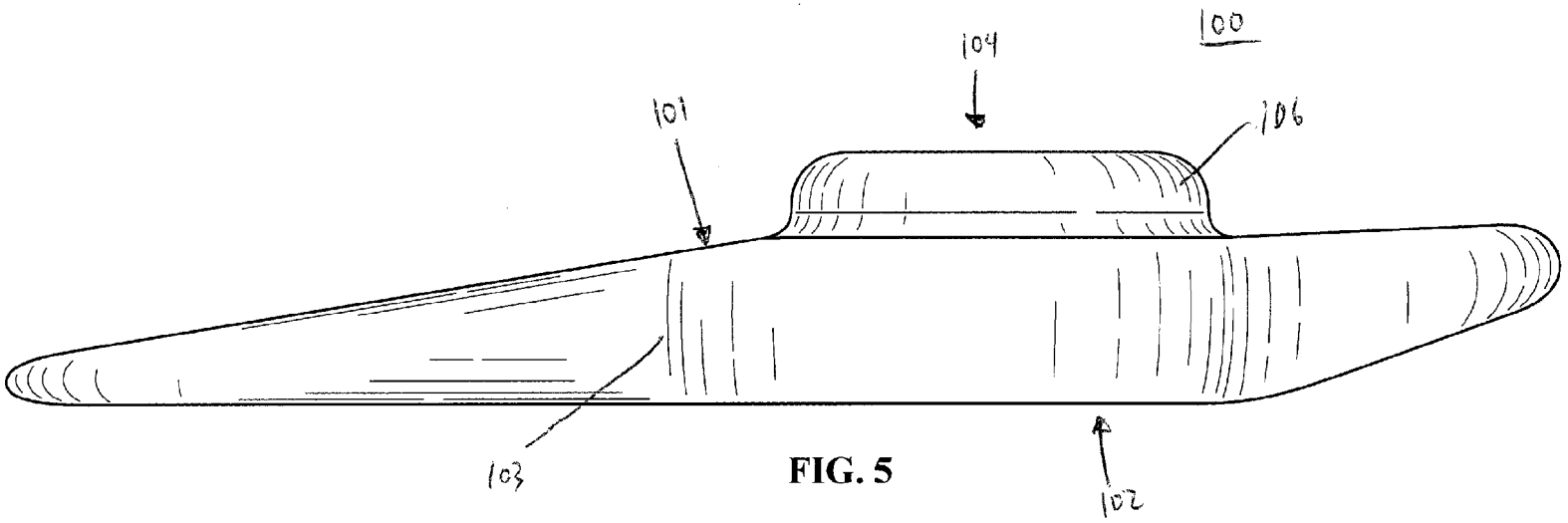
FIG. 5 is another side view of a first embodiment of the present invention.

As shown in FIGS. 4-5, the top surface 101 may have a head receiving area 107 that is generally perpendicular to a floor or resting surface. The leg receiving area 108 may be slanted or graded from about the abdominal opening 104/ second chamber 106 to the terminal end of the leg receiving area. This causes an angling of the pelvic area of a user which is supported by the "heightened" second chamber 106 and allows the legs of a user to comfortably lay on the support apparatus 100 at a downward angle (see FIG. 8).

The angle formed by the relationship to the pelvis or hips and legs of the user may be critical in relieving lower back pain and other afflictions. In one embodiment the angle formed between the legs/hips of a user in relation to their upper body may be between about 180° to about 270° (conversely about 0° to about 90° depending on method of measurement).

In some embodiments, the support apparatus 100, when inflated, has a maximum thickness of about 0.25 inches to about 12 inches and more preferably about 9 inches. Further, the support apparatus 100 may have a varying thickness along a length of the apparatus. For example, the head receiving area 107 may have a thickness of about 9 inches whereas at a terminal end of the leg receiving area the thickness is only about 1 inch. Various other slopes or grades may be implemented by the embodiments of the present invention.

Figure 6:
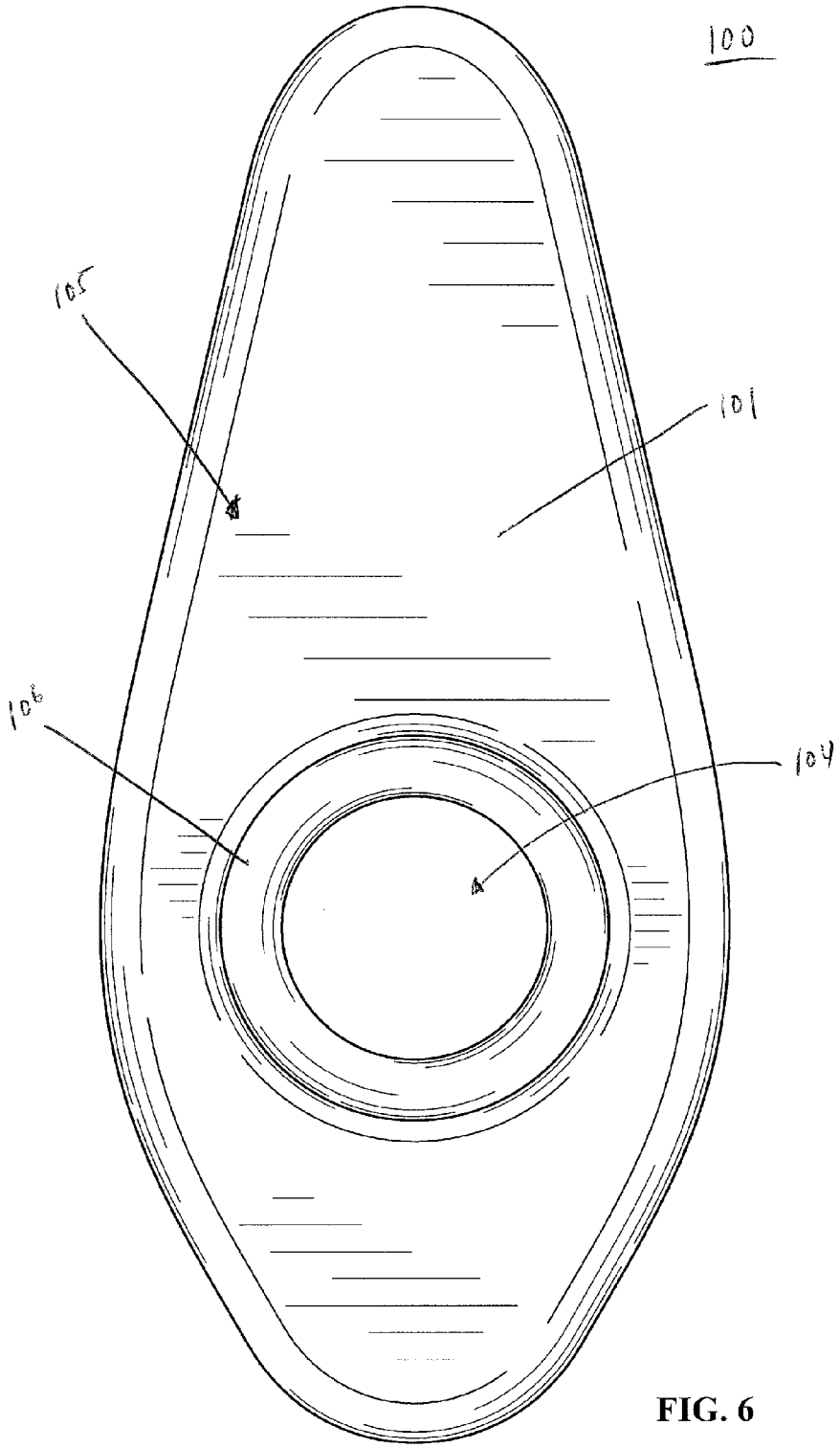
FIG. 6 is a top view of a first embodiment of the present invention.
Figure 7:
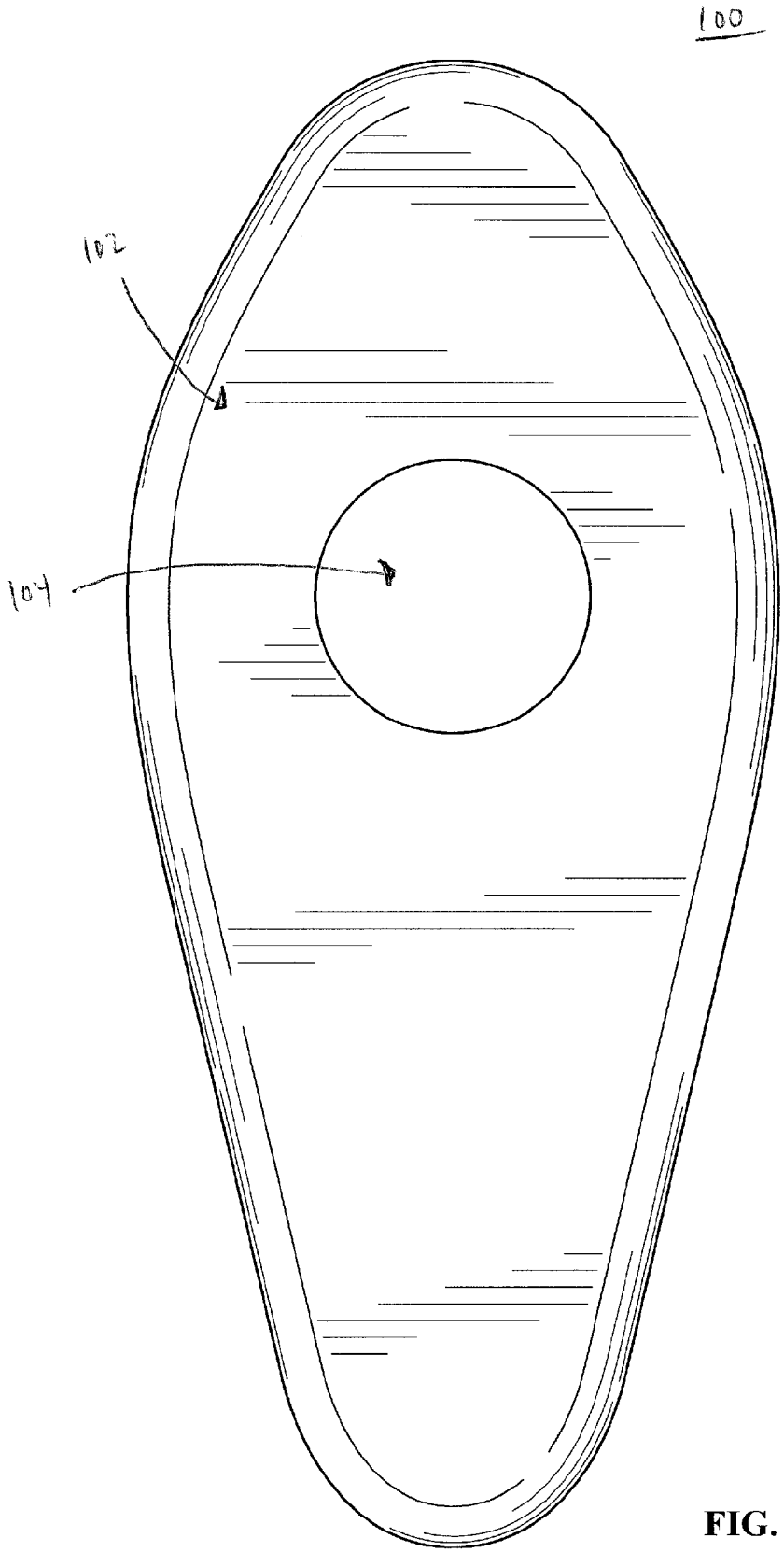
FIG. 7 is a bottom view of a first embodiment of the present invention.
Figure 8:
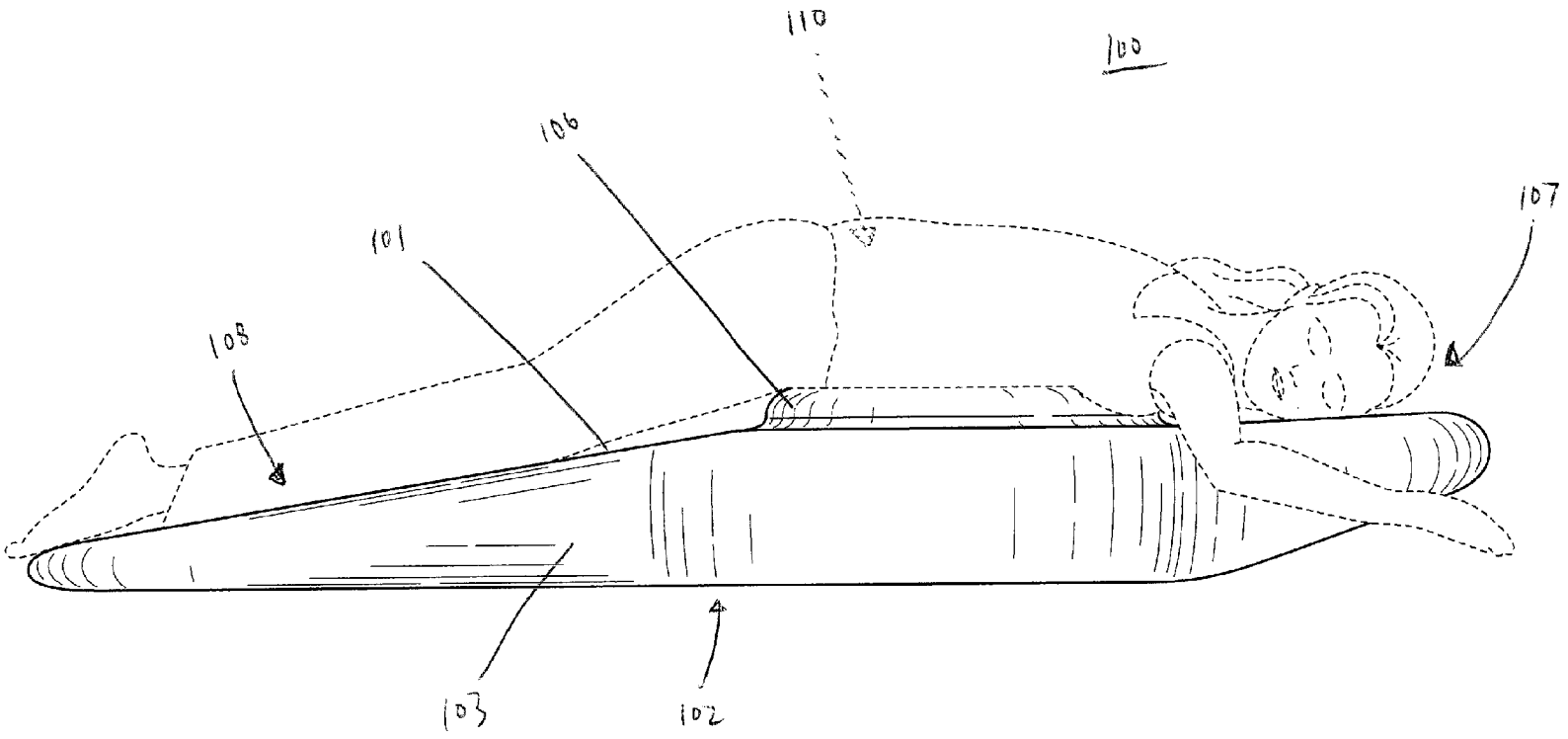
FIG. 8 is a side view demonstrating a potential usage of an embodiment of the present invention.
Figure 9:
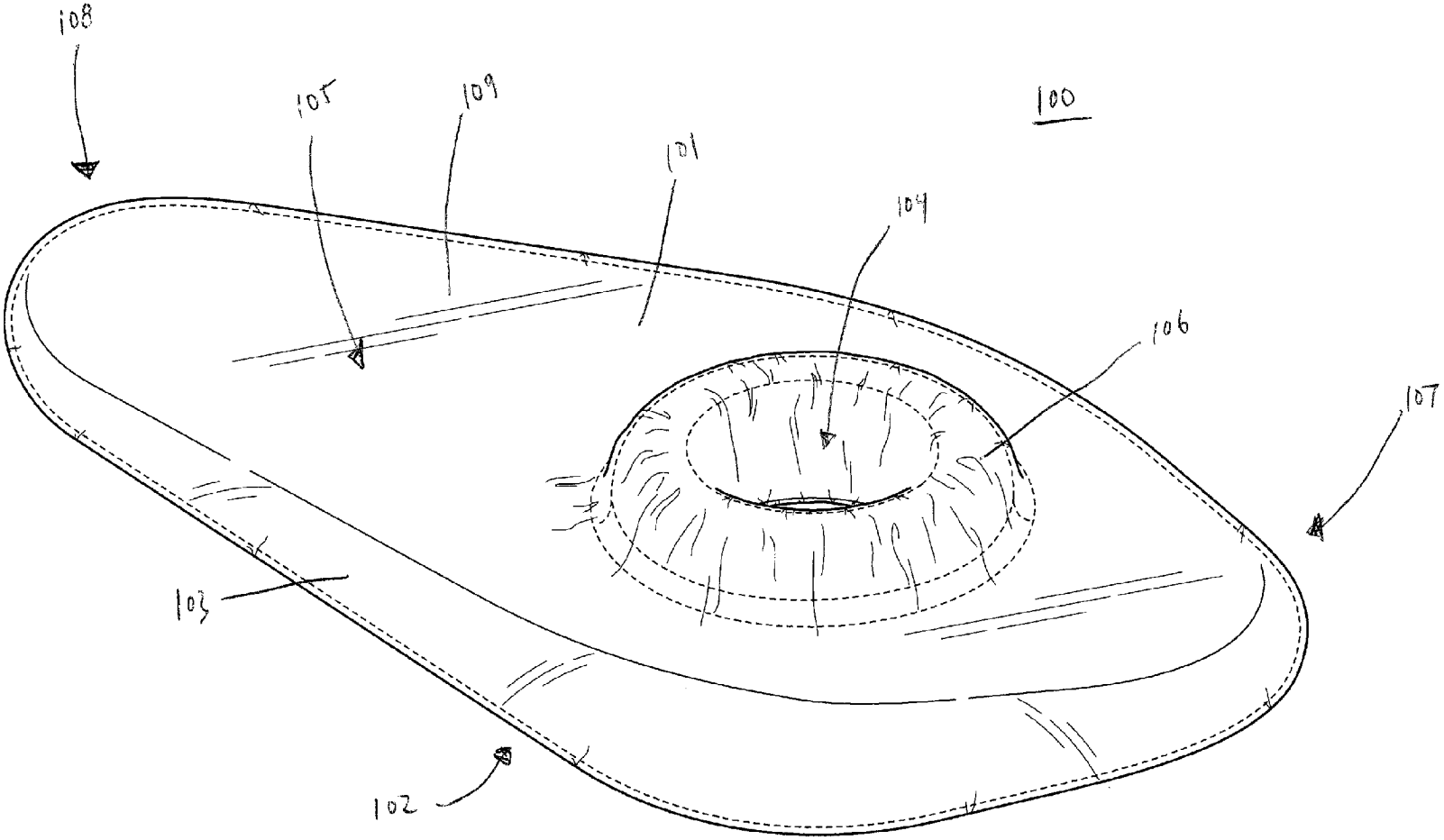
FIG. 9 is a perspective view of a second embodiment of the present invention.
Figure 10:
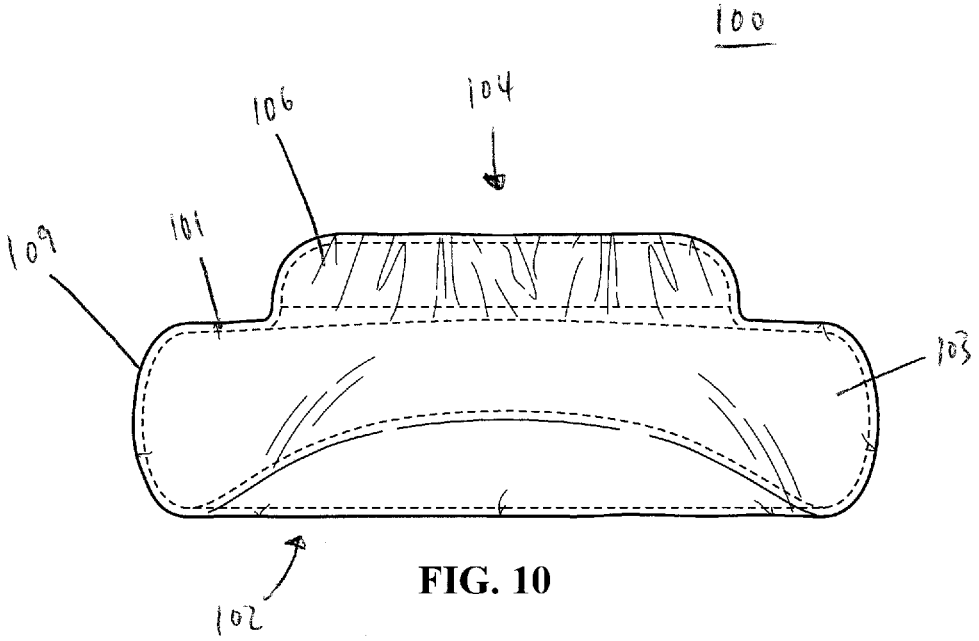
FIG. 10 is a front view of a second embodiment of the present invention.
Figure 11:
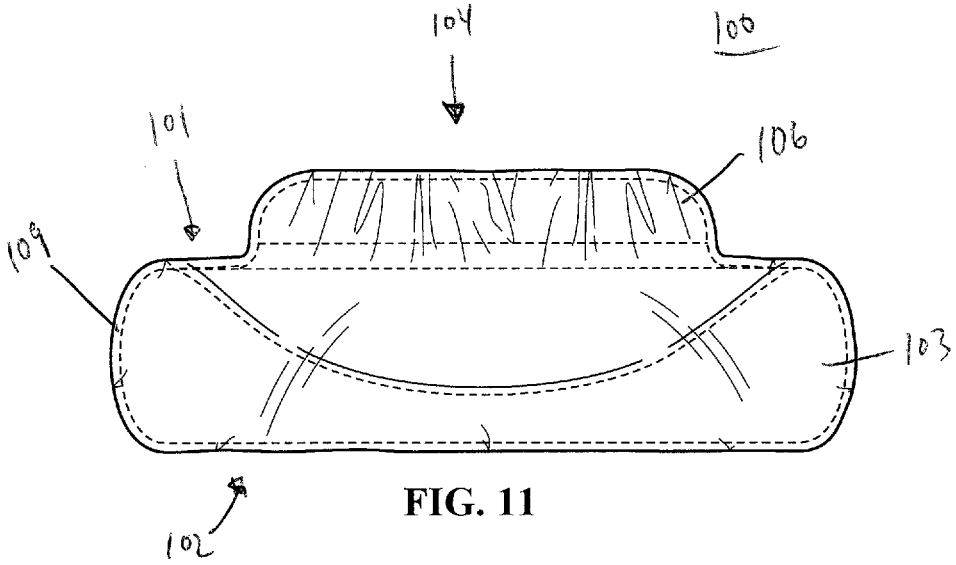
FIG. 11 is a back view of a second embodiment of the present invention.
Figure 12:
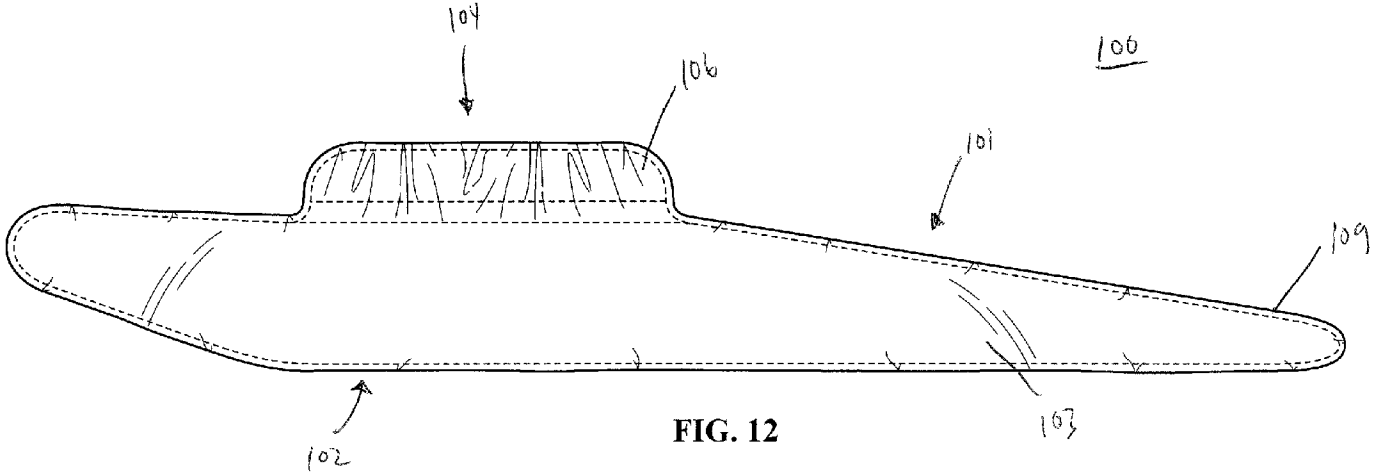
FIG. 12 is a side view of a second embodiment of the present invention.
Figure 13:
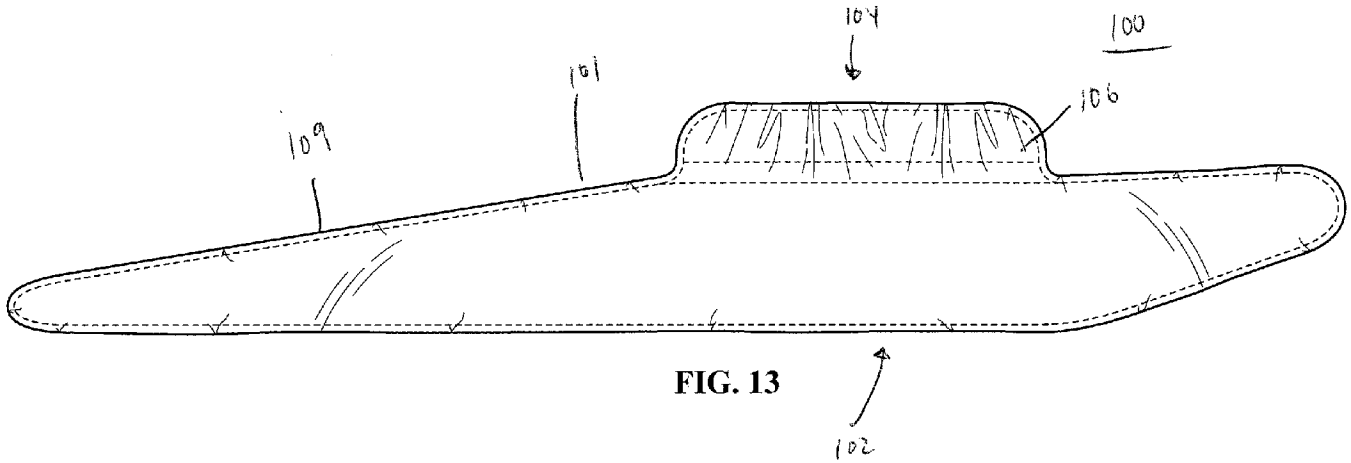
FIG. 13 is another side view of a second embodiment of the present invention.
Figure 14:
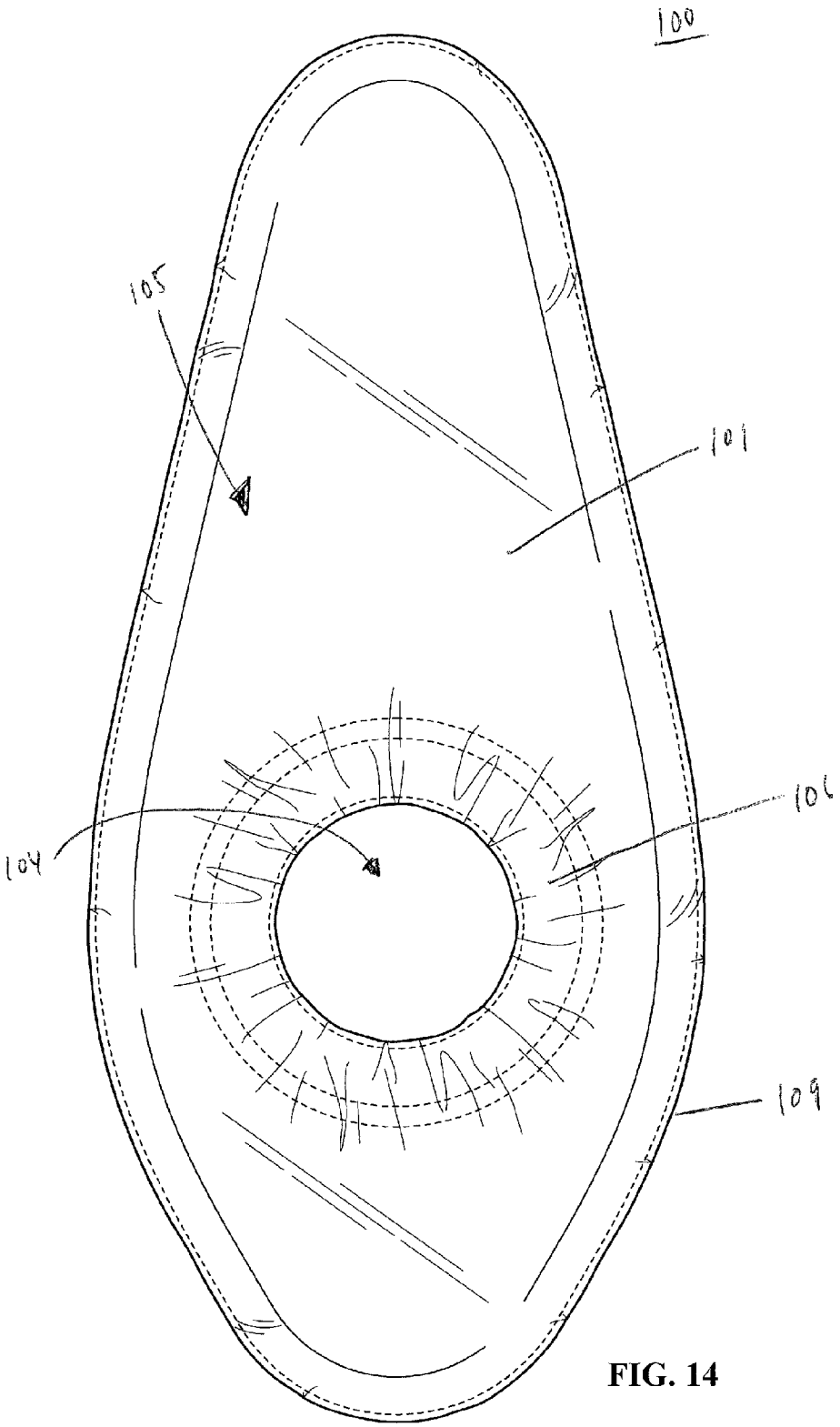
FIG. 14 is a top view of a second embodiment of the present invention.
Figure 15:
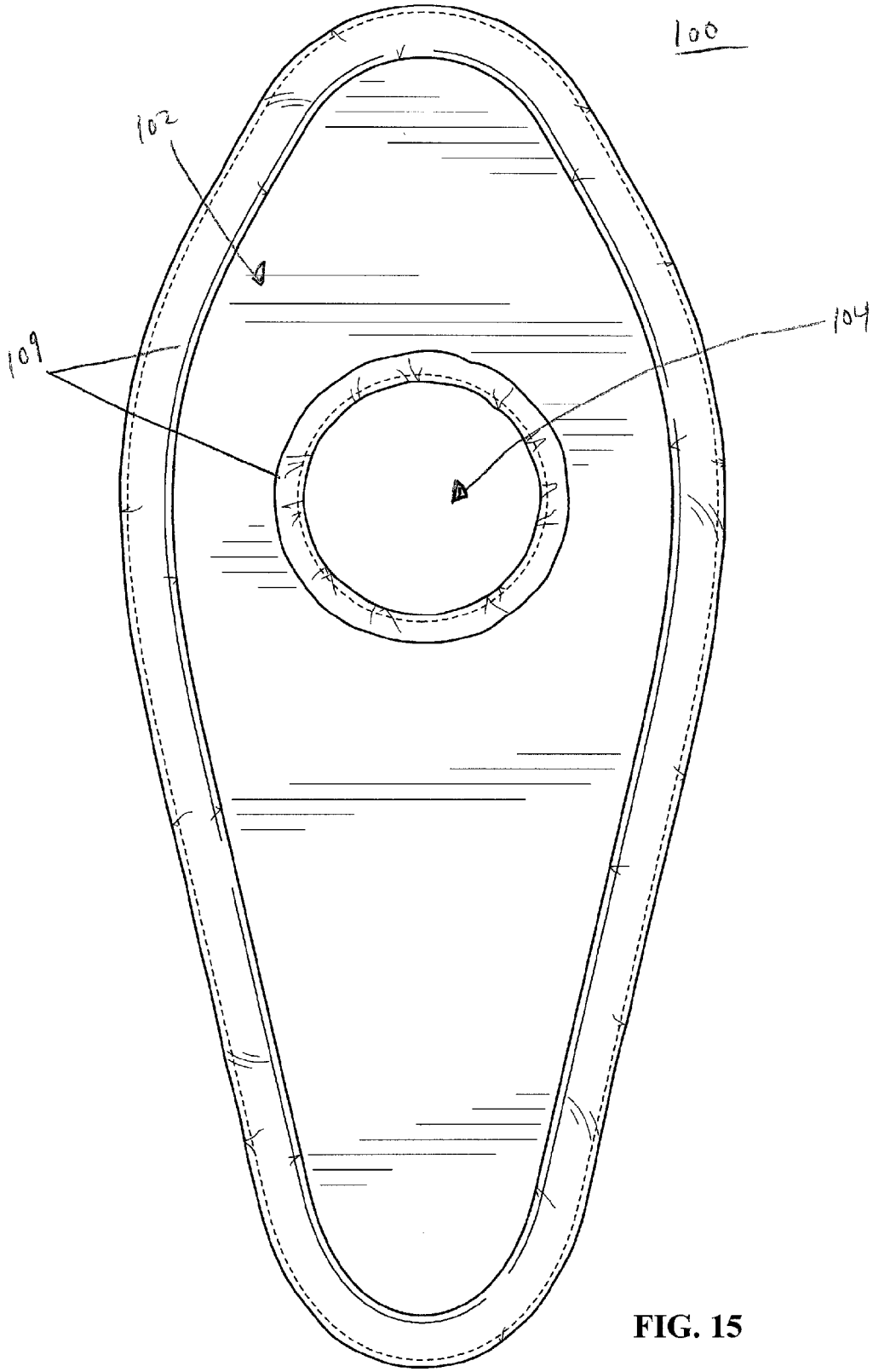
FIG. 15 is a bottom view of a second embodiment of the present invention.
Figure 16:
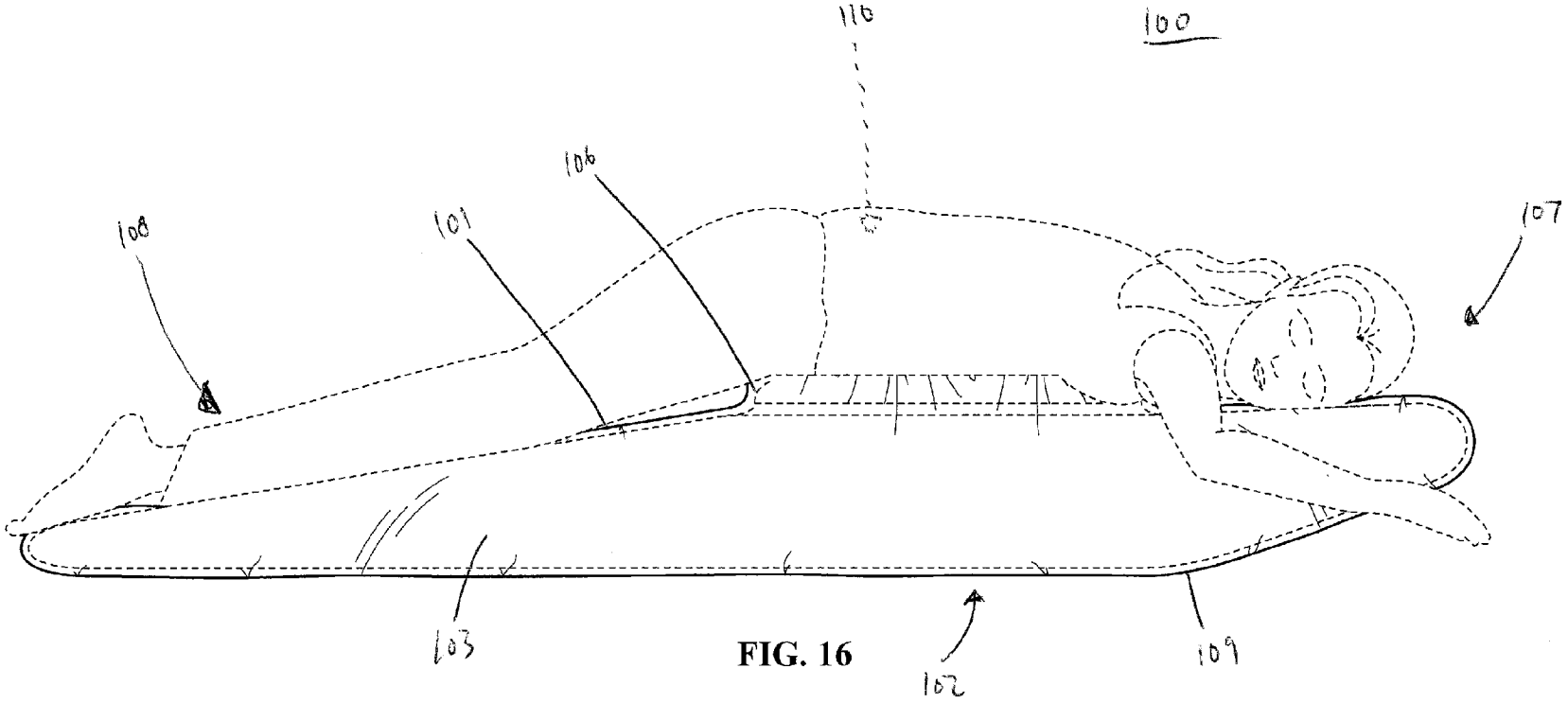
FIG. 16 is a side view demonstrating a potential usage of an embodiment of the present invention.
Figure 17:
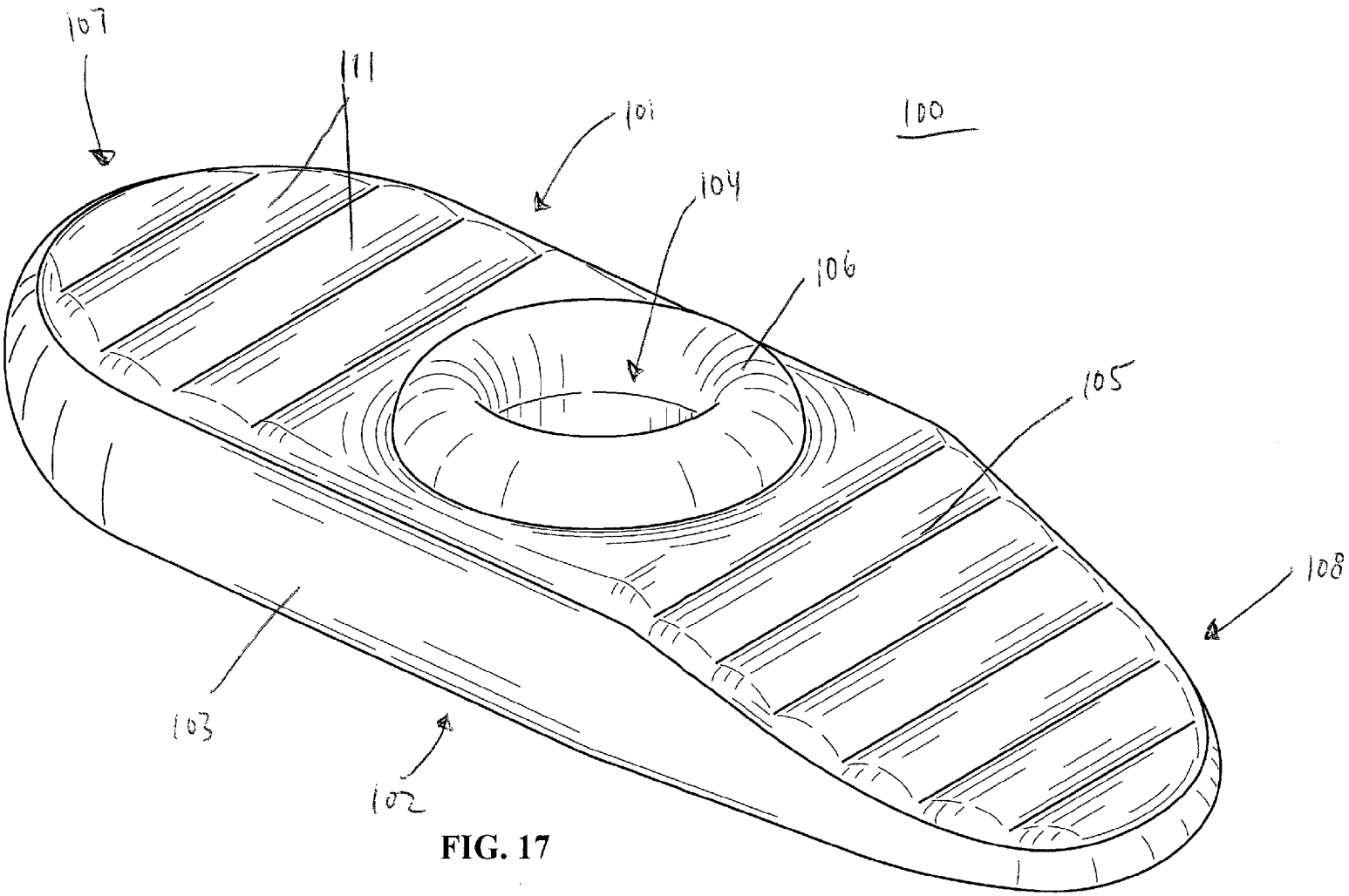
FIG. 17 is a perspective view of a third embodiment of the present invention.
Figure 18:
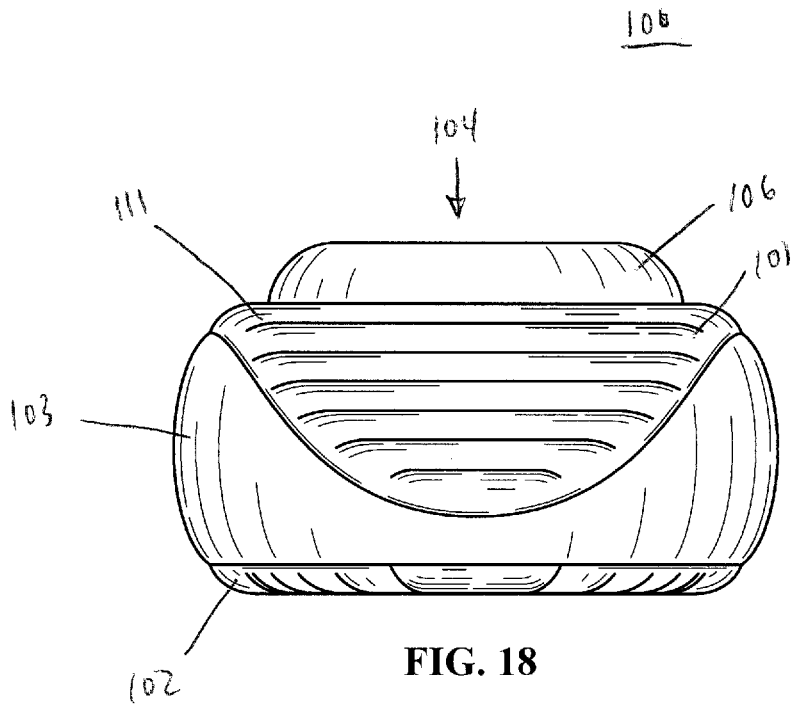
FIG. 18 is a front view of a third embodiment of the present invention.
Figure 19:
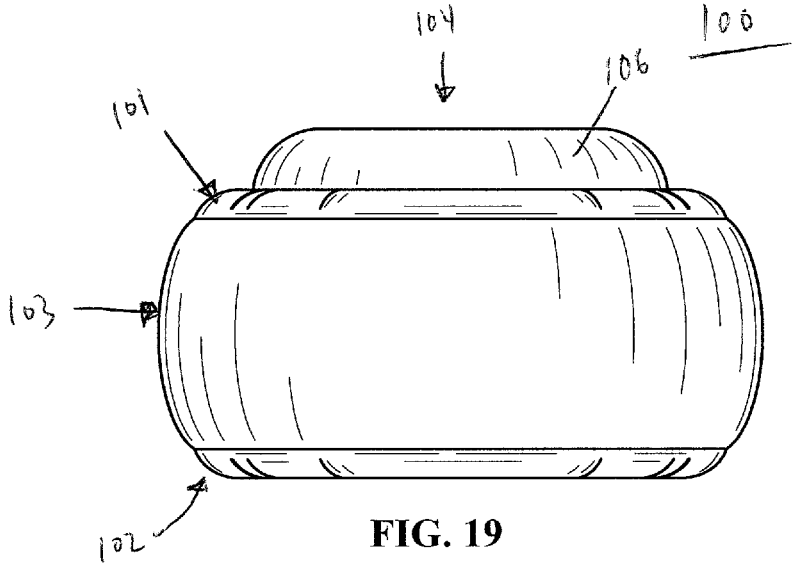
FIG. 19 is a back view of a third embodiment of the present invention.
Figure 20:
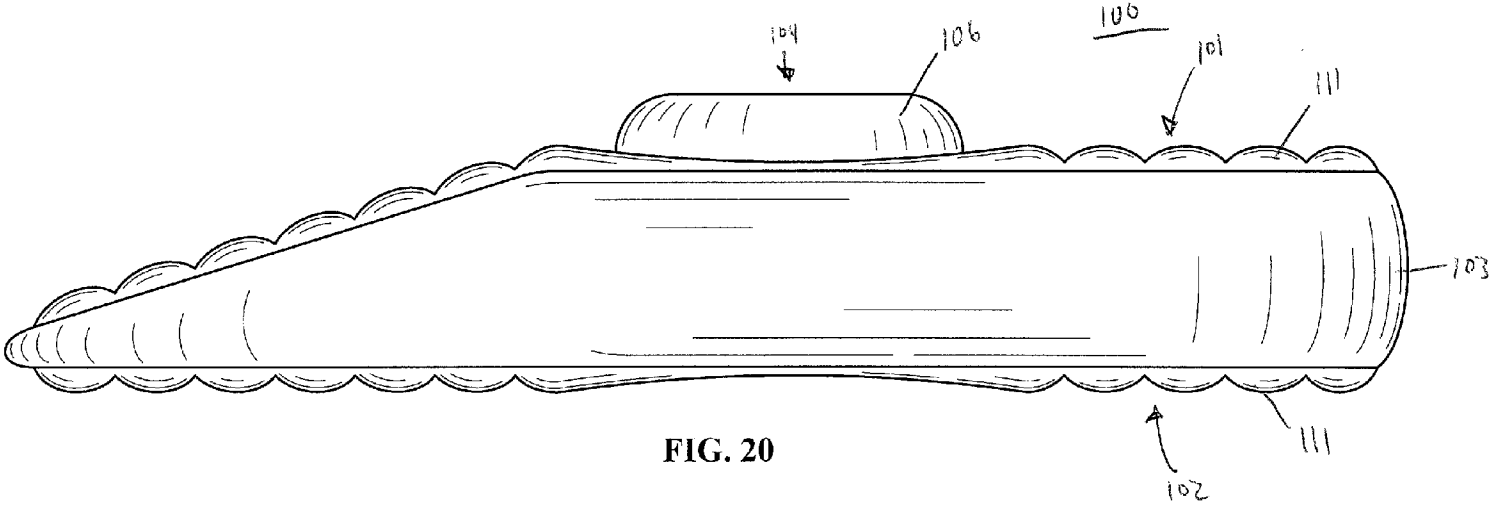
FIG. 20 is a side view of a third embodiment of the present invention.
Figure 21:
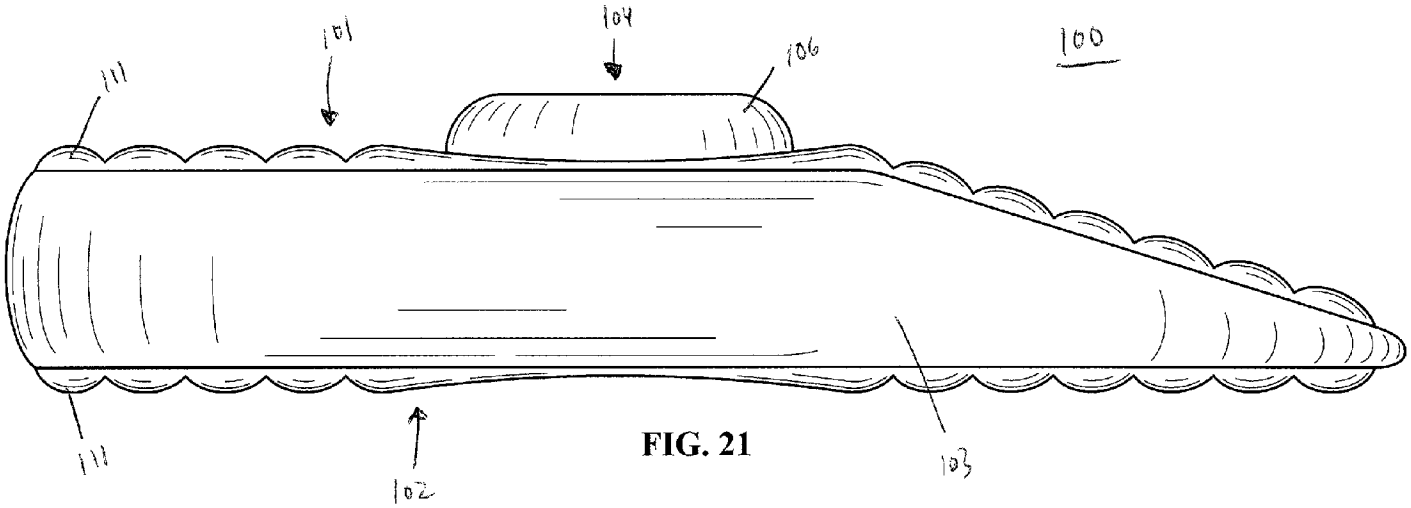
FIG. 21 is another side view of a third embodiment of the present invention.
Figure 22:
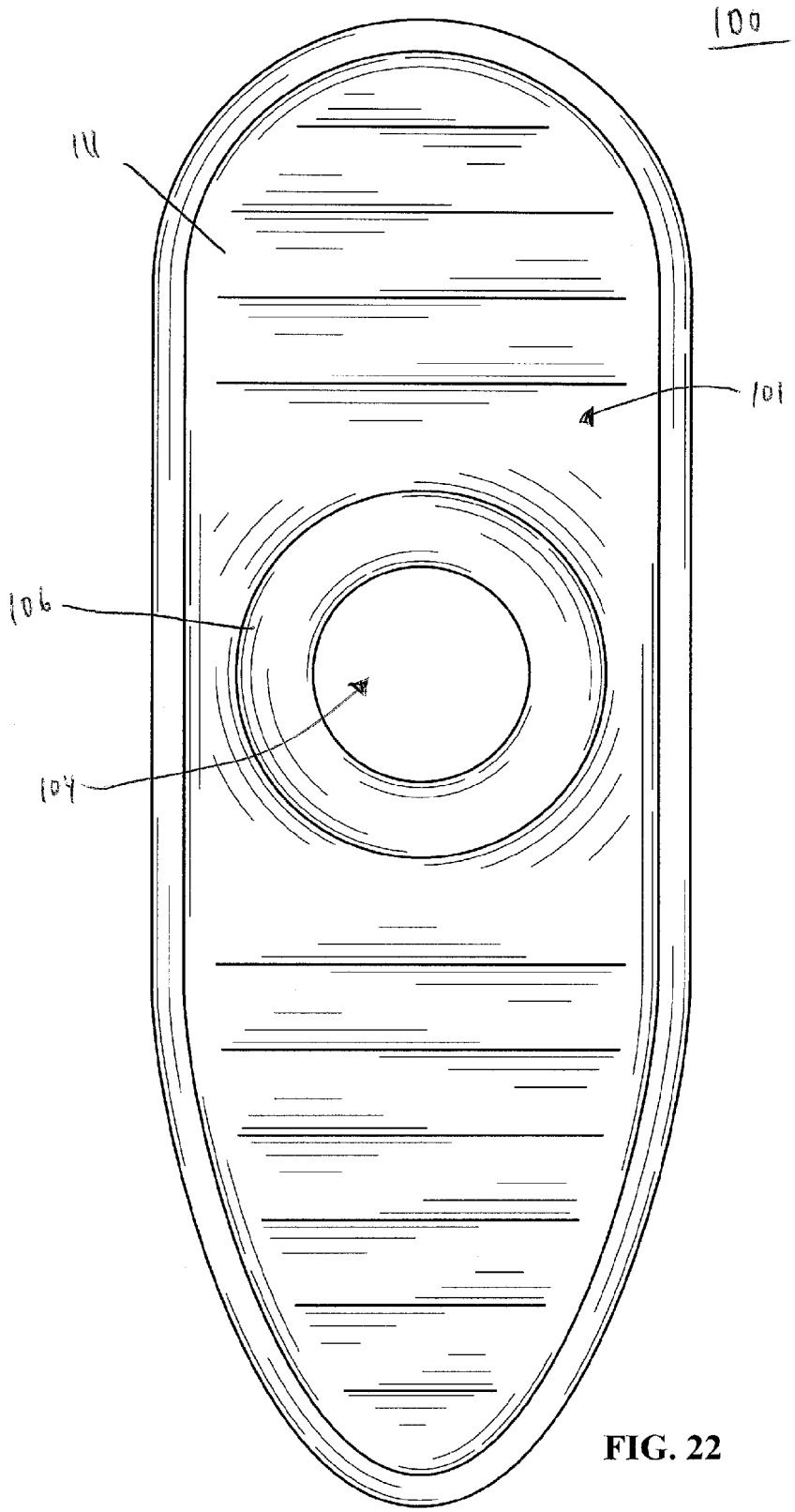
FIG. 22 is a top view of a third embodiment of the present invention.
Figure 23:
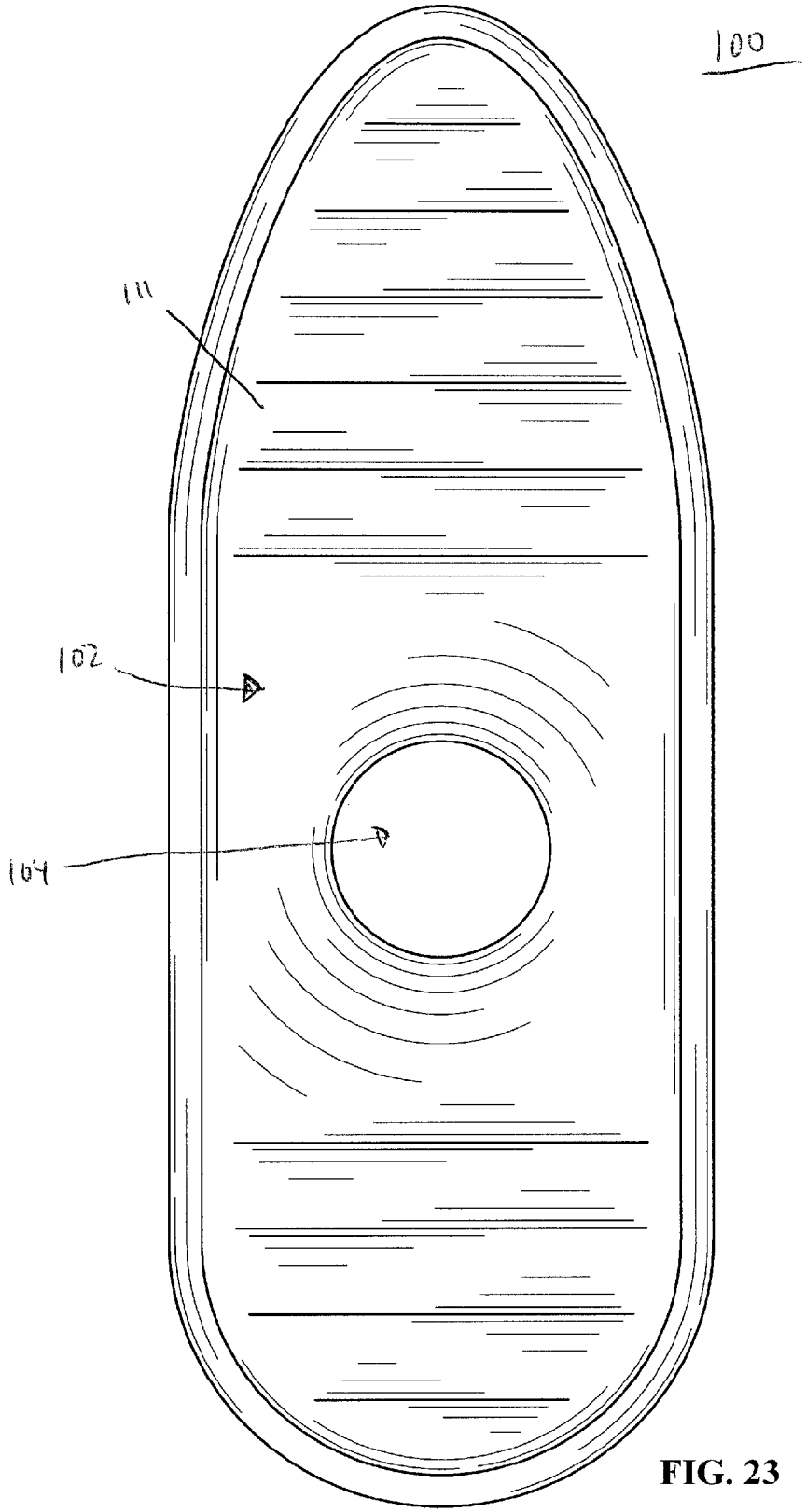
FIG. 23 is a bottom view of a third embodiment of the present invention.
Figure 24:
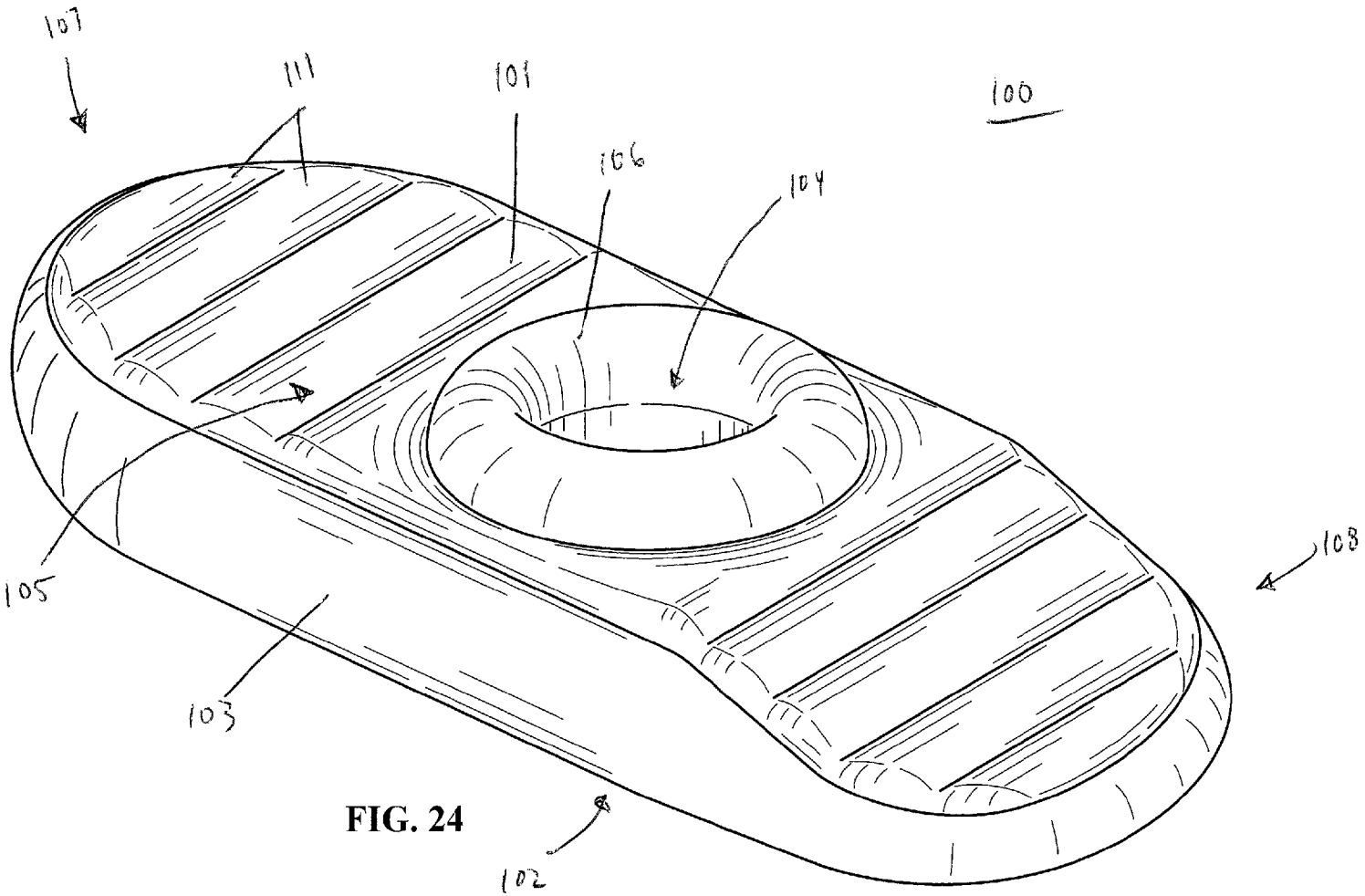
FIG. 24 is a perspective view of a fourth embodiment of the present invention.
Figure 25:
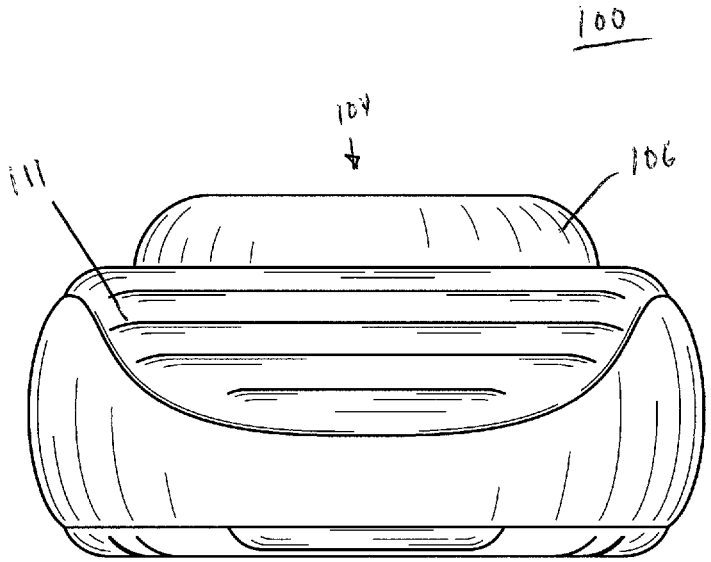
FIG. 25 is a front view of a fourth embodiment of the present invention.
Figure 26:
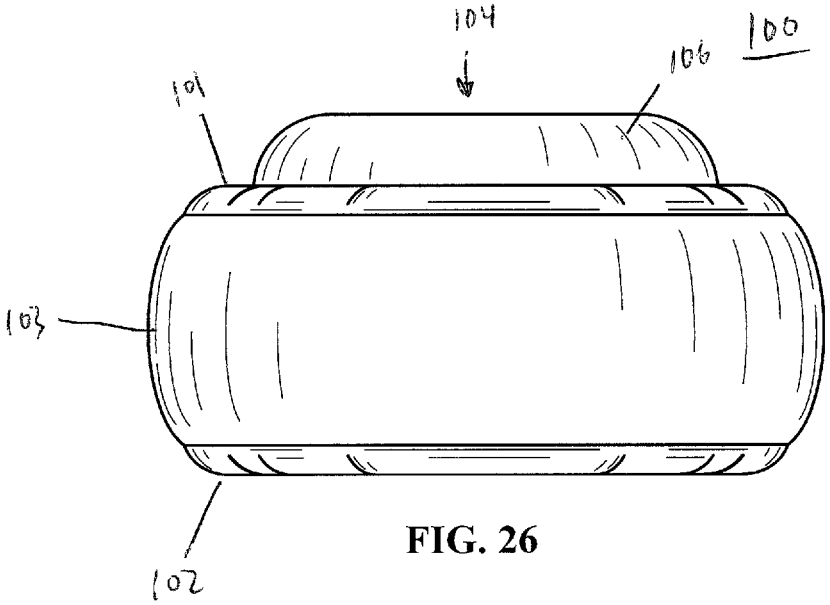
FIG. 26 is a back view of a fourth embodiment of the present invention.
Figure 27:
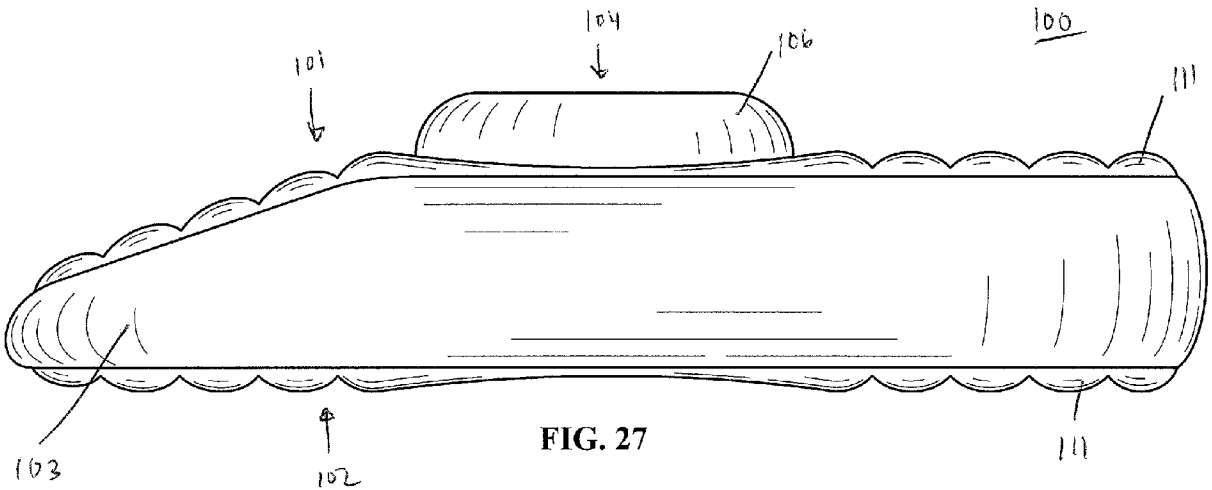
FIG. 27 is a side view of a fourth embodiment of the present invention.
Figure 28:
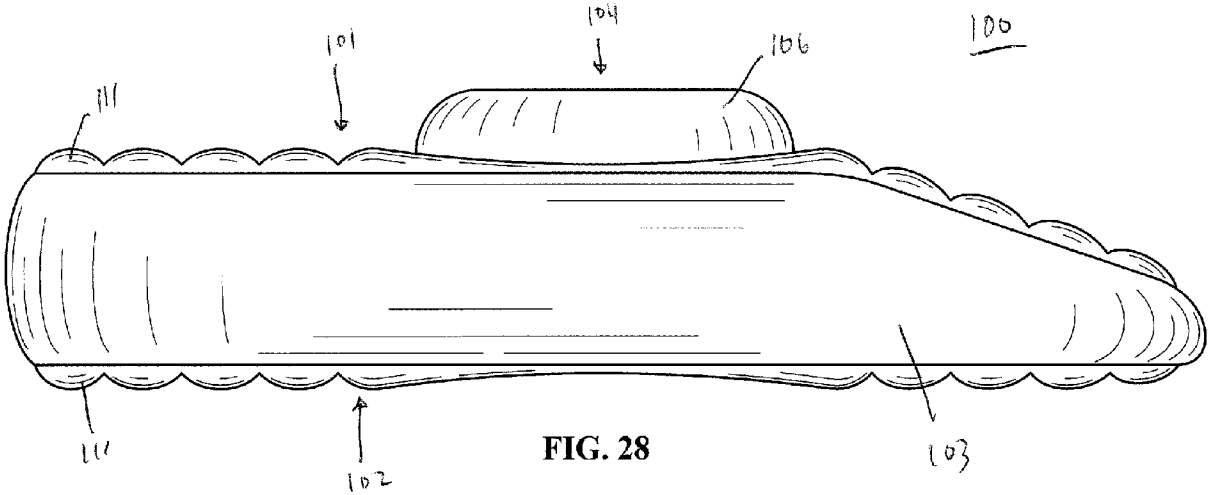
FIG. 28 is another side view of a fourth embodiment of the present invention.

When viewed from the top and bottom, as shown in FIGS. 6-7 respectively, the shape of the support apparatus 100 is apparent. The support apparatus 100, in this embodiment, is generally widest at about the abdominal opening 104 and narrower at each of the two ends. Such a shape provides space for the user's arms to be placed by the sides if desired.

The support apparatus 100 may comprises a number of materials including but not limited to plastics, resins, composites, and or some combination thereof. Plastics may include but are not limited to polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof.

Additionally, the present invention may comprise a combination of classes of materials such as a plastic and a textile (inner plastic layer, outer fabric layer) such as woven or unwoven fabric, cloth, terrycloth, woven or non-woven fibers of wool, flax, cotton, and synthetic textiles including but not limited to nylon, polyester, and/or acrylic, or any combinations thereof. Preferably, the present invention and its embodiments are selected for their lightweight and durable properties.

Further, the support apparatus 100 may be of varying dimensions intended to support a variety of users. In one embodiment a preferred length of the support apparatus 100 is about 48 inches to about 100 inches and more preferably about 72 inches. In one embodiment the preferred width of the support apparatus 100 is about 18 inches to about 48 inches and is more preferably about 24 inches. The abdominal opening 104 may be about 12 inches to about 24 inches in diameter and may be more preferably about 14 inches. The second chamber 106 may have a width of about 2 inches to about 12 inches and is more preferably about 4 inches. Further, the second chamber may have a height of about 0.25 inch to about 12 inches above the top surface 101 of the support apparatus 100 and is more preferably about 4 inches in height.

FIGS. 9-16 describe another embodiment of the present invention. The embodiment shown is similar to that described in FIGS. 1-8 above, but further comprises a covering or covering member 109 partially covering the support apparatus 100. The covering 108 may be configured to cover the top surface 101, side surface 103, or bottom surface 102 or a combination thereof.

The covering 109 may be coupled using hook and loop fasteners or elastic rutching or other suitable coupling means. It is intended that the covering 109 is to be easily removable and positionable by at least one person. The covering 109 may further have an opening such that it covers the desired surfaces of the support apparatus 100 but leaves the abdominal opening 104 uncovered. In other embodiments, enough covering material is utilized such that the covering 109 is a continuous piece that couples to a bottom side of the abdominal opening 104 or "sags" or hangs down into the abdominal opening 104 so as not to interfere with the user.

In addition, the covering 109 may comprise materials such as but not limited to: woven or unwoven fabric, cloth, terrycloth, woven or woven fibers of wool, flax, cotton, and/or yarn, and synthetic textile including but not limited to nylon, polyester, and/or acrylic, or any combinations thereof. In other embodiments, the covering 109 may comprise one or more layers including at least one layer that is waterproof or water resistant.

Referring now to FIGS. 17-23, there is another embodiment of the present invention. Here, the top surface 101 and the bottom surface 102 contain ridges 111 to provide comfort to a user during periods of use. The ridges 111 may comprise individual chambers that can be inflated or deflated as appropriate, or the chambers may be integral with the first chamber 105. In other embodiments, the ridges 111 may only be present on the top surface 101 or the bottom surface 102. In yet other embodiments, the ridges 111 are capable of being coupled to the support apparatus 100 in a similar fashion to the covering thereby providing selective use of this feature.

Figure 29:
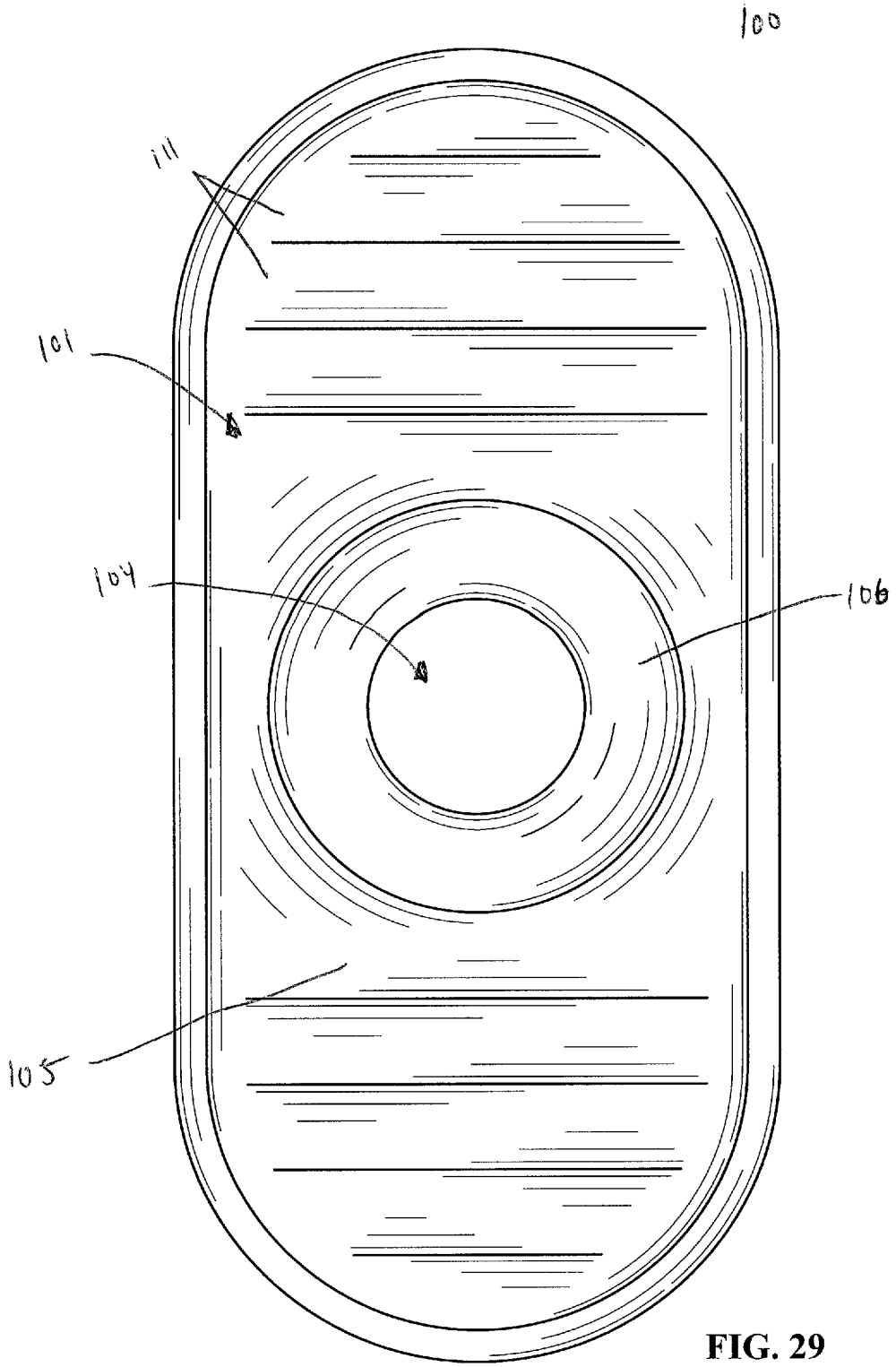
FIG. 29 is a top view of a fourth embodiment of the present invention.
Figure 30:
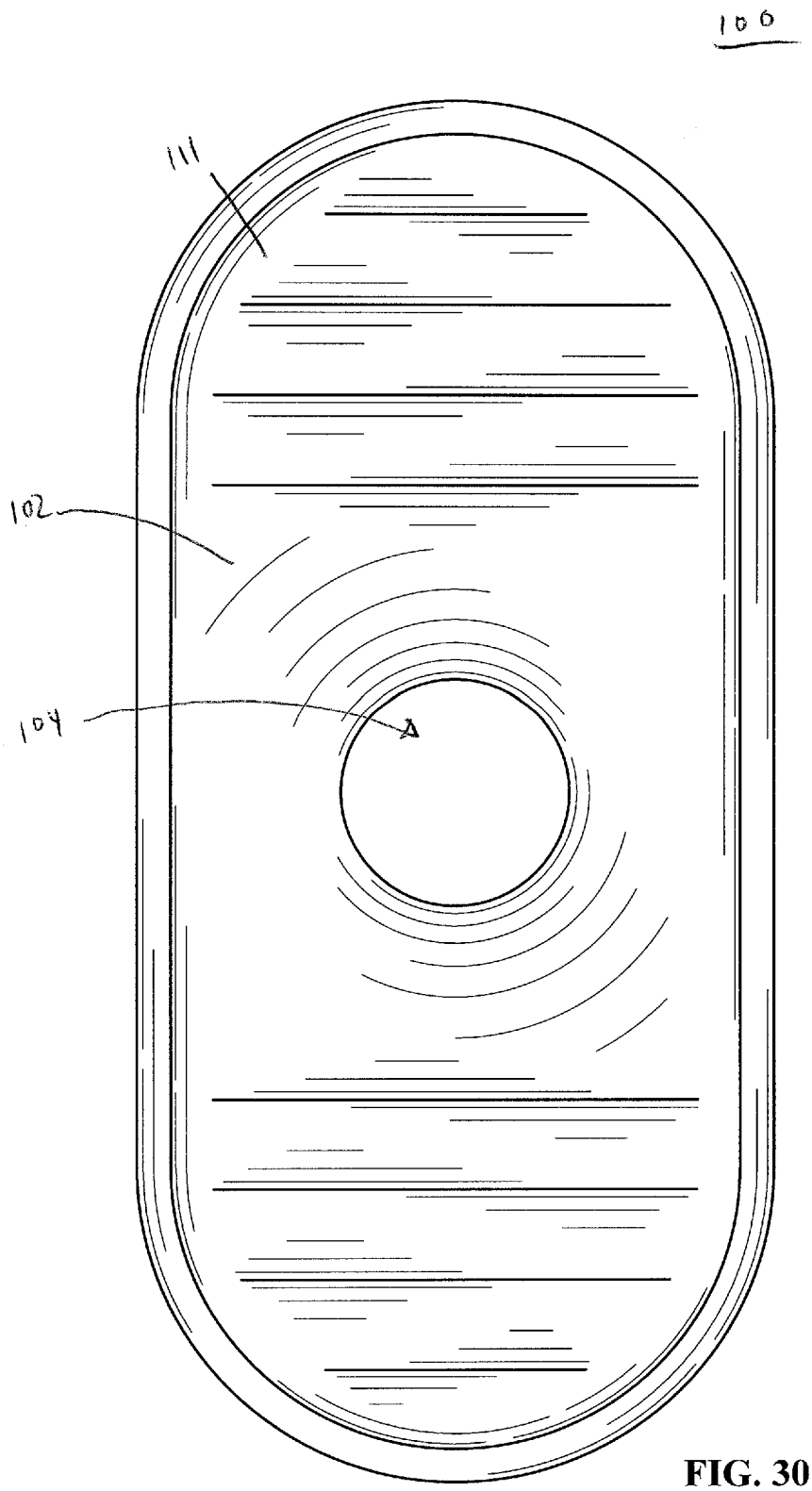
FIG. 30 is a bottom view of a fourth embodiment of the present invention.
Figure 31:
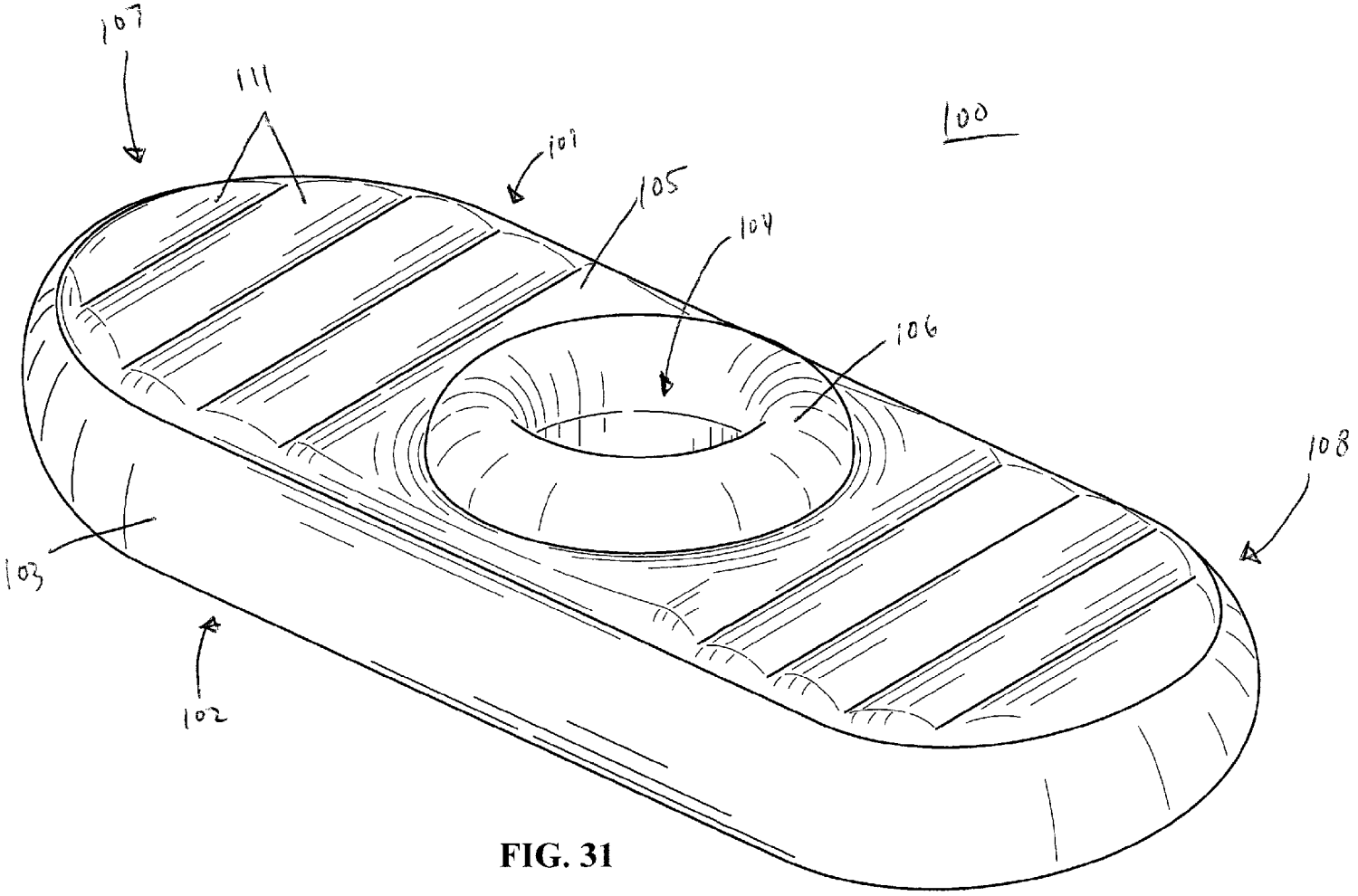
FIG. 31 is a perspective view of a fifth embodiment of the present invention.
Figure 32:
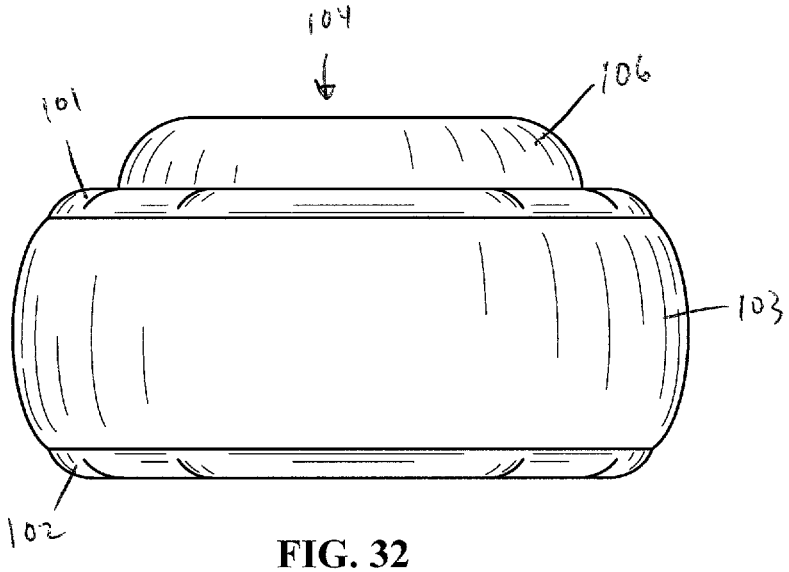
FIG. 32 is a front view of a fifth embodiment of the present invention.
Figure 33:
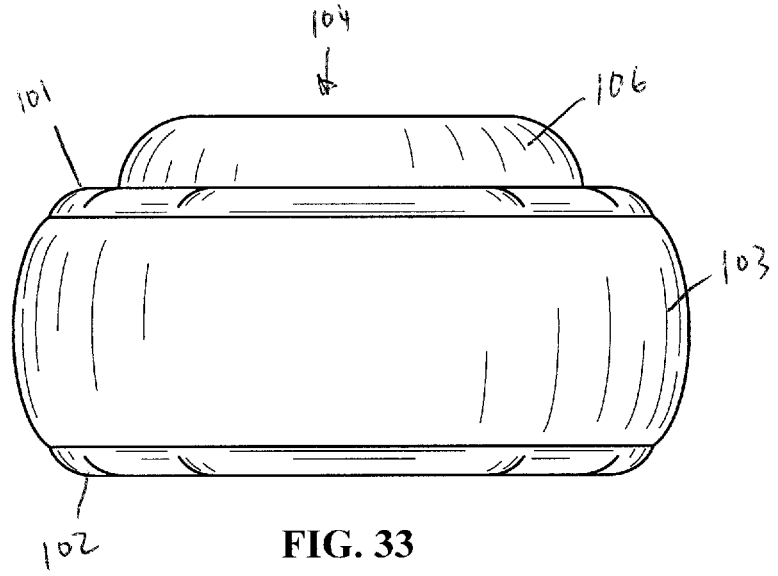
FIG. 33 is a back view of a fifth embodiment of the present invention.
Figure 34:
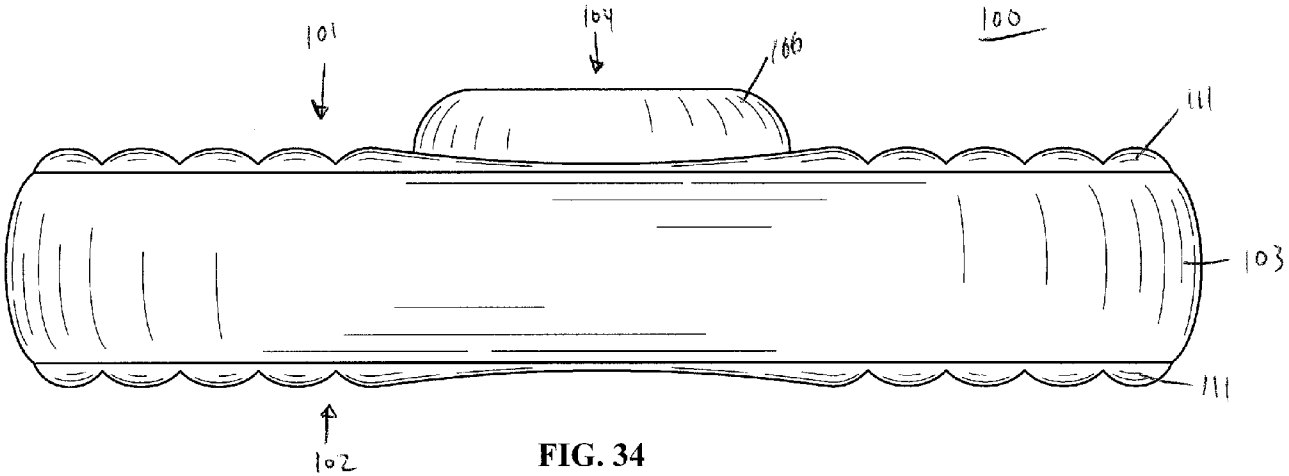
FIG. 34 is a side view of a fifth embodiment of the present invention.
Figure 35:
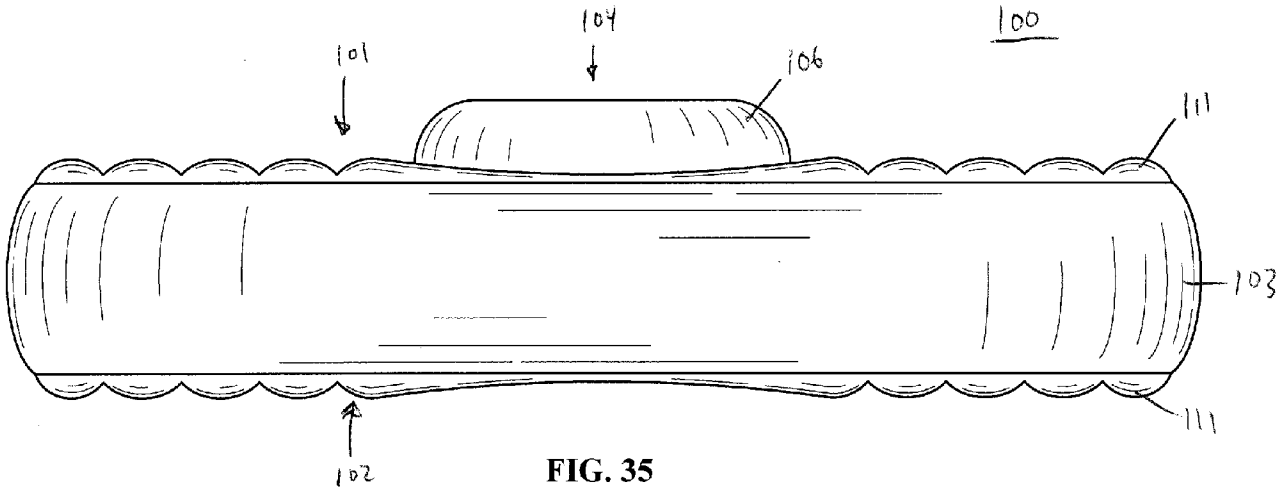
FIG. 35 is another side view of a fifth embodiment of the present invention.
Figure 36:
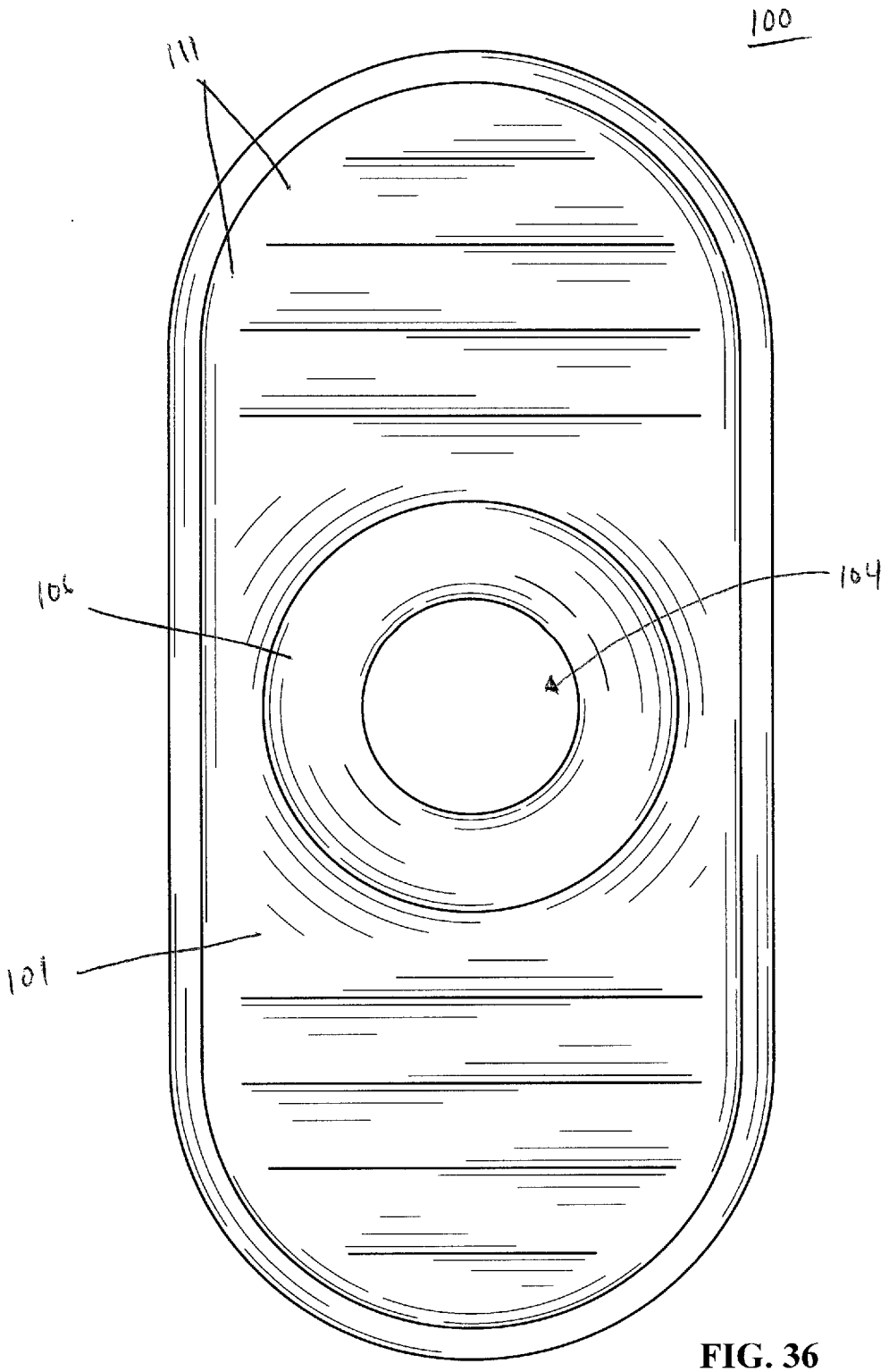
FIG. 36 is a top view of a fifth embodiment of the present invention.
Figure 37:
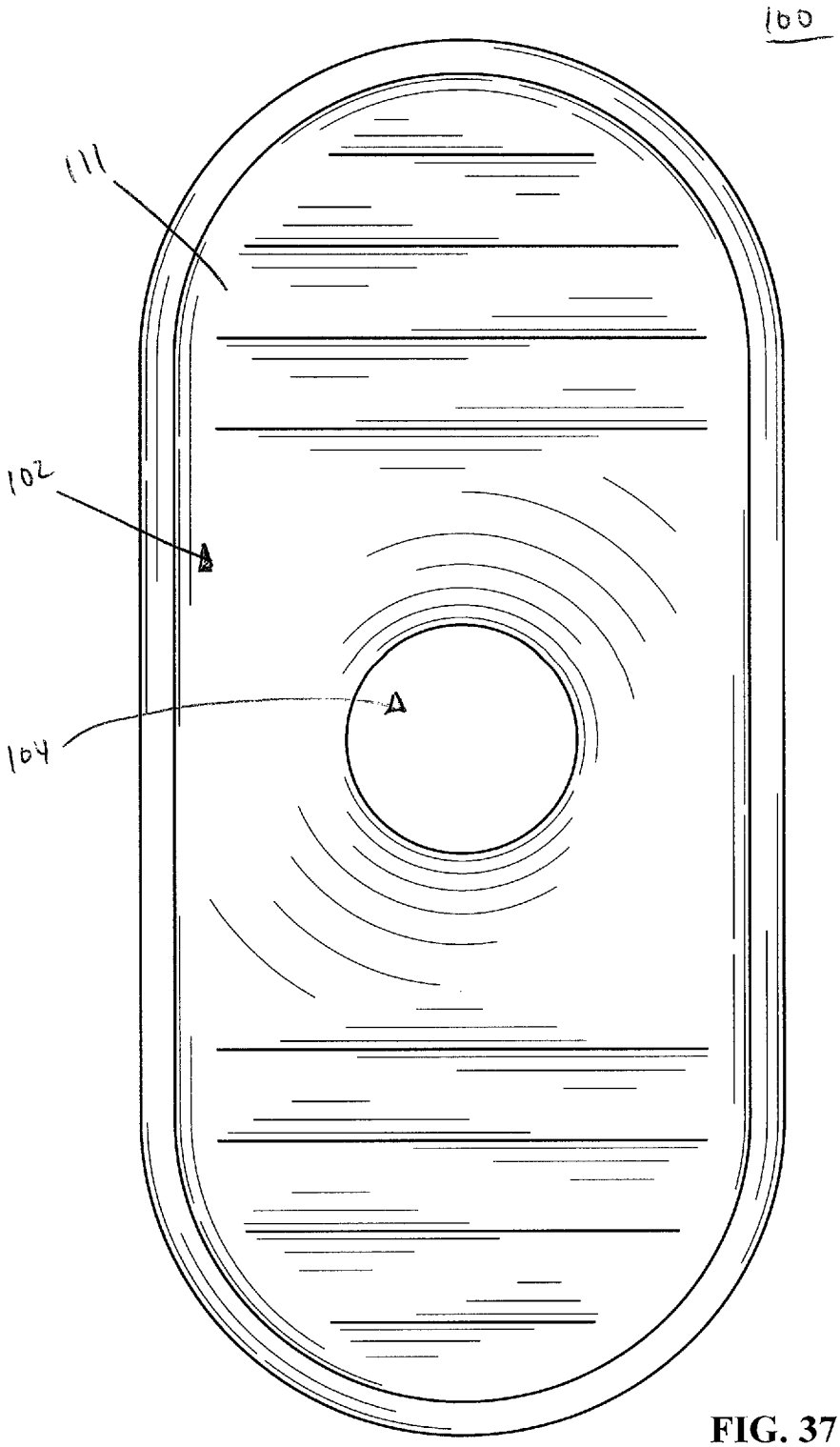
FIG. 37 is a bottom view of a fifth embodiment of the present invention.
Figure 38:
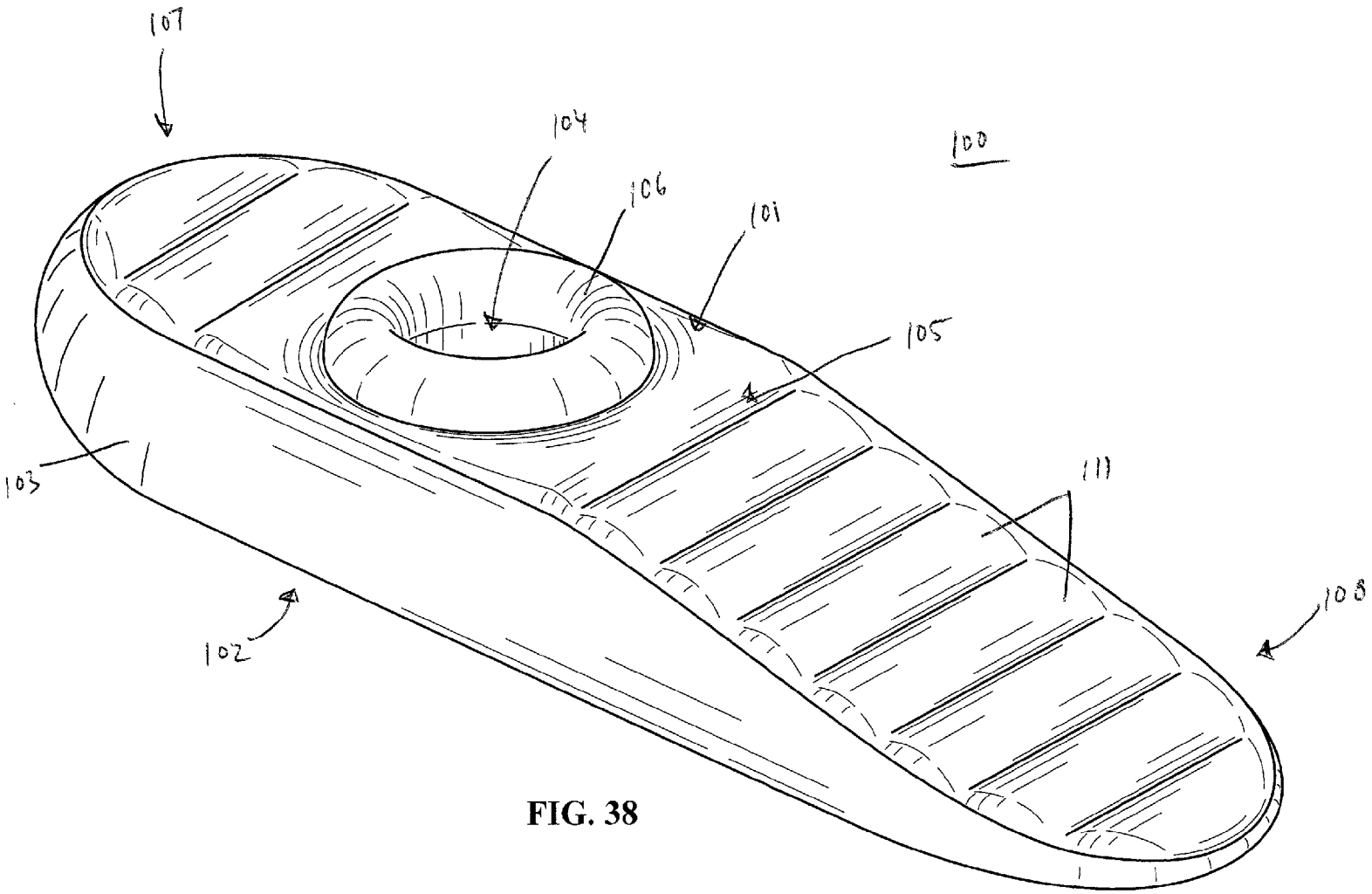
FIG. 38 is a perspective view of a sixth embodiment of the present invention.
Figure 39:
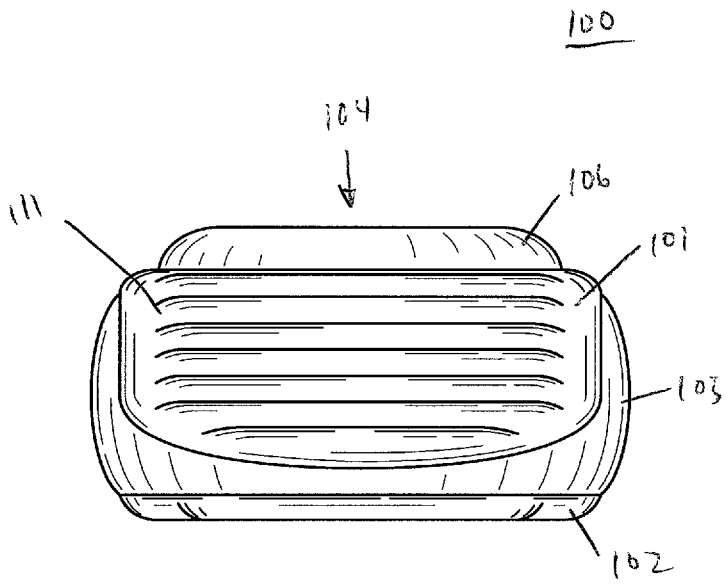
FIG. 39 is a front view of a sixth embodiment of the present invention.
Figure 40:
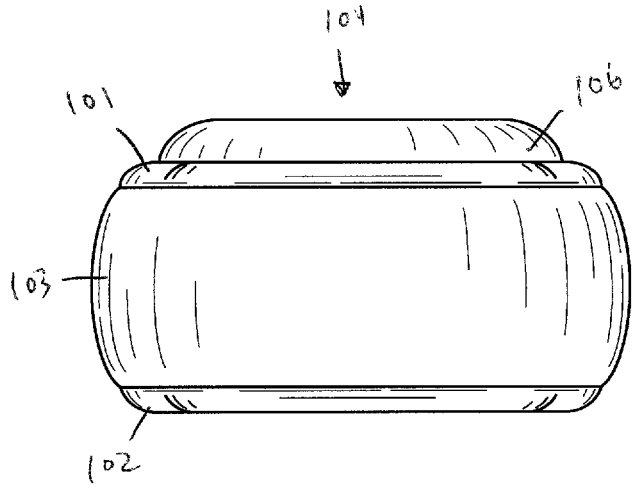
FIG. 40 is a back view of a sixth embodiment of the present invention.
Figure 41:
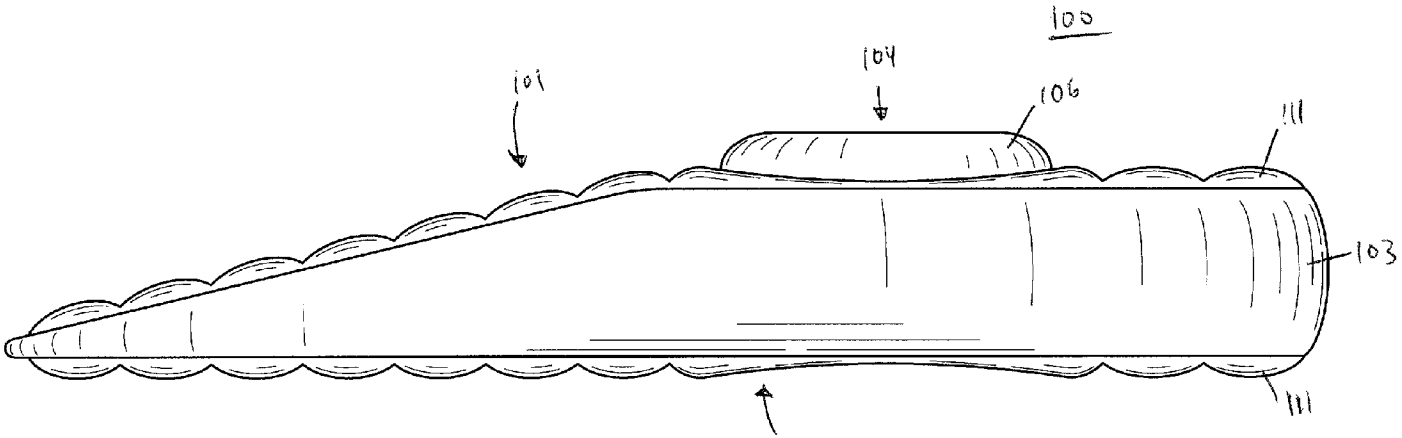
FIG. 41 is a side view of a sixth embodiment of the present invention.
Figure 42:
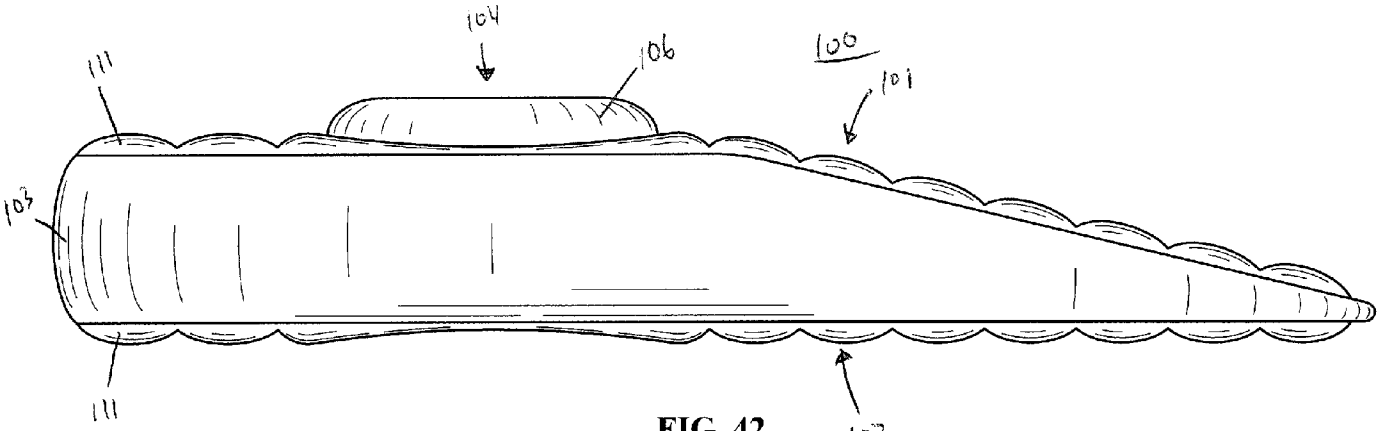
FIG. 42 is another side view of a sixth embodiment of the present invention.
Figure 43:
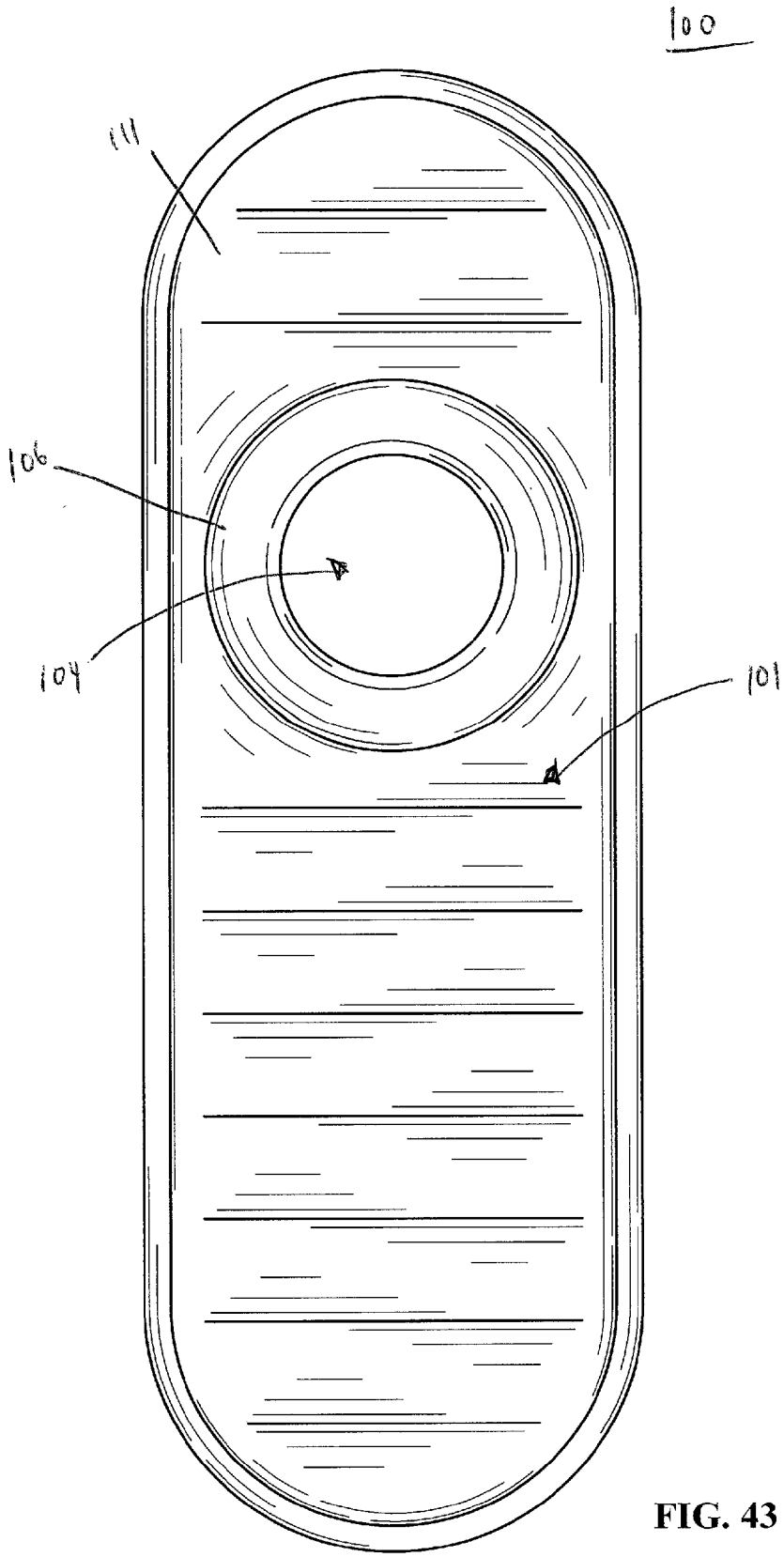
FIG. 43 is a top view of a sixth embodiment of the present invention.
Figure 44:
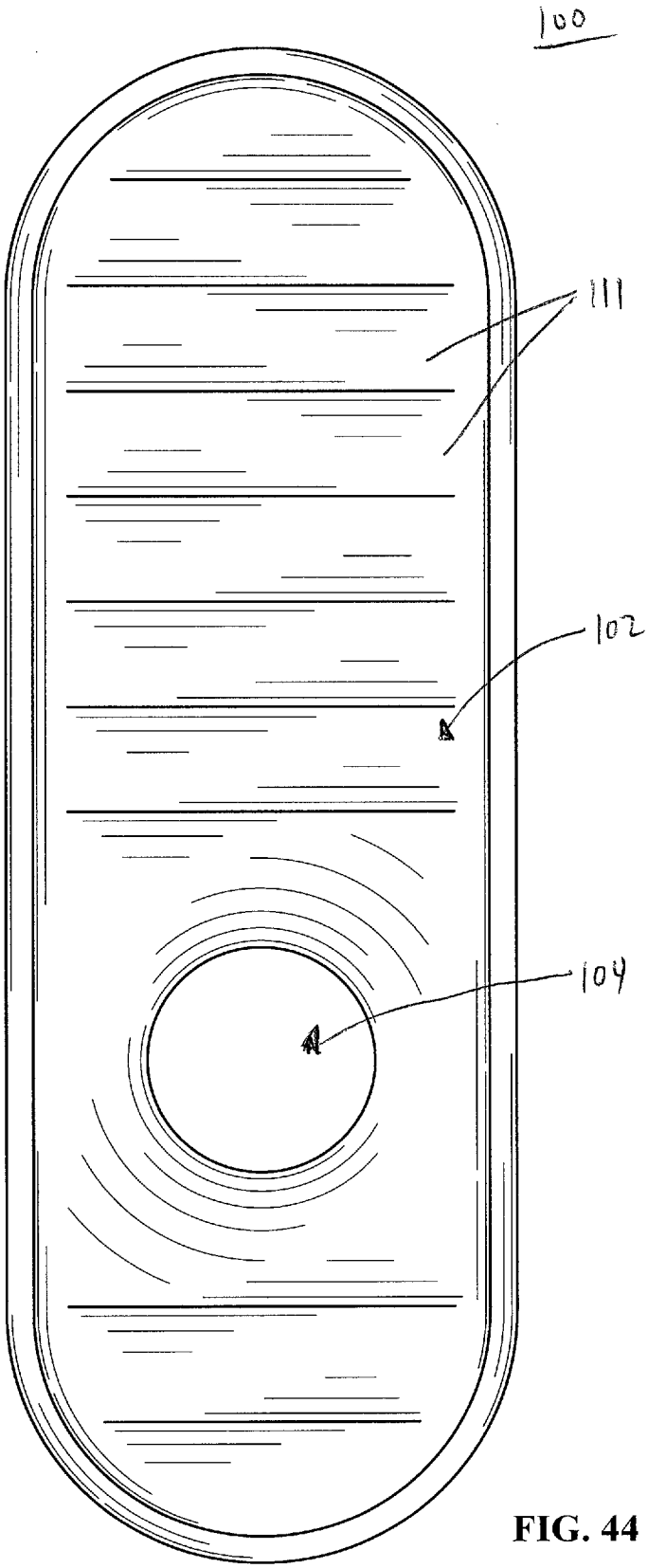
FIG. 44 is a bottom view of a sixth embodiment of the present invention.
Figure 45:
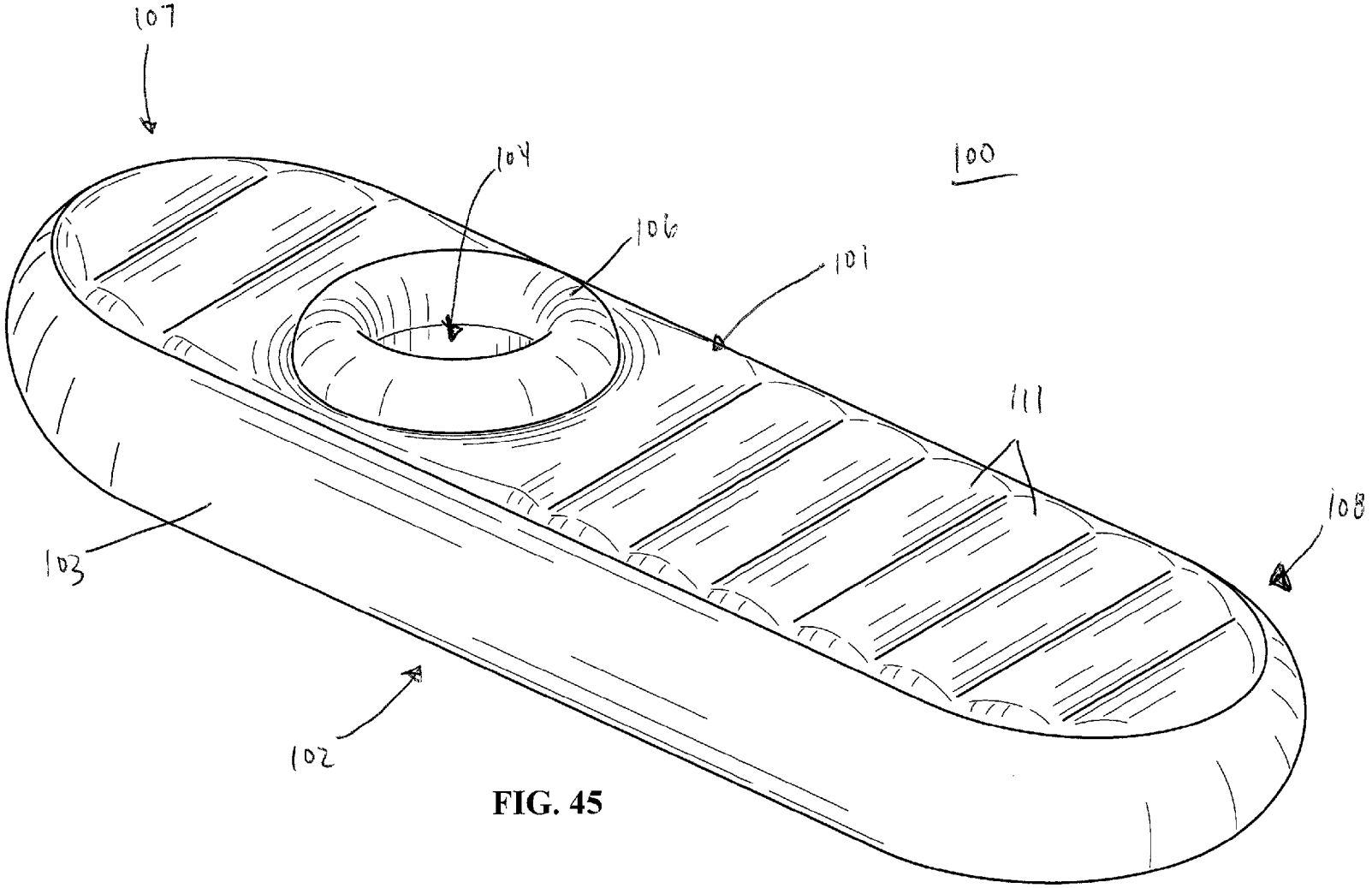
FIG. 45 is a perspective view of a seventh embodiment of the present invention.
Figure 46:
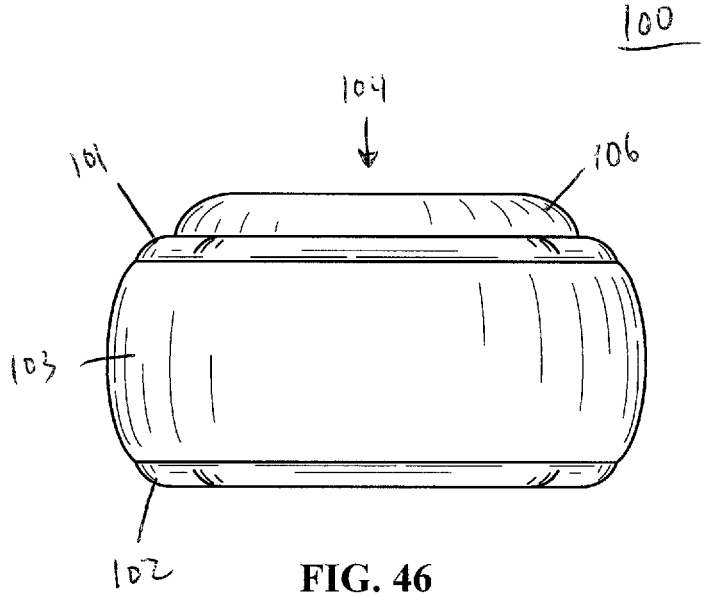
FIG. 46 is a front view of a seventh embodiment of the present invention.
Figure 47:
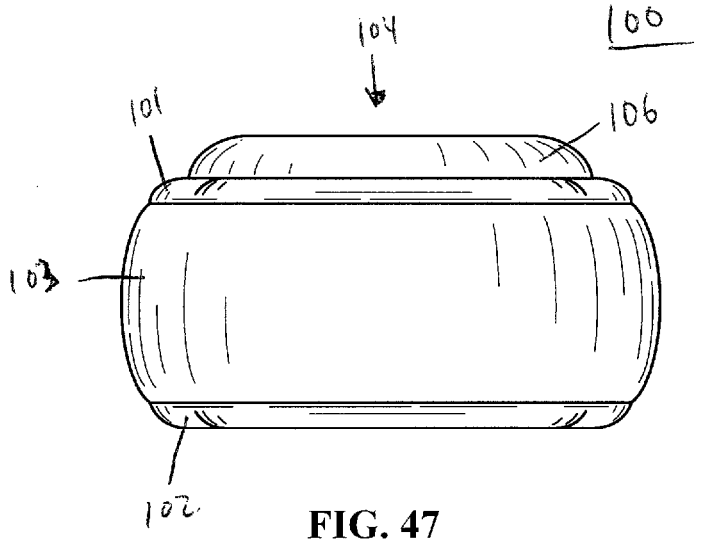
FIG. 47 is a back view of a seventh embodiment of the present invention.
Figure 48:
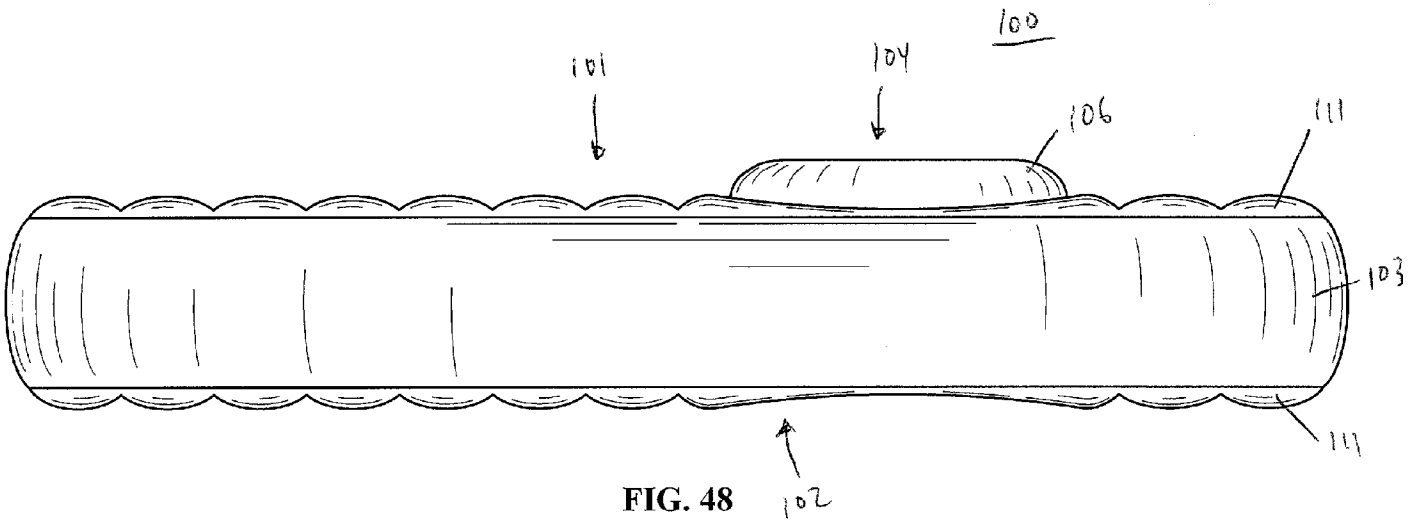
FIG. 48 is a side view of a seventh embodiment of the present invention.
Figure 49:
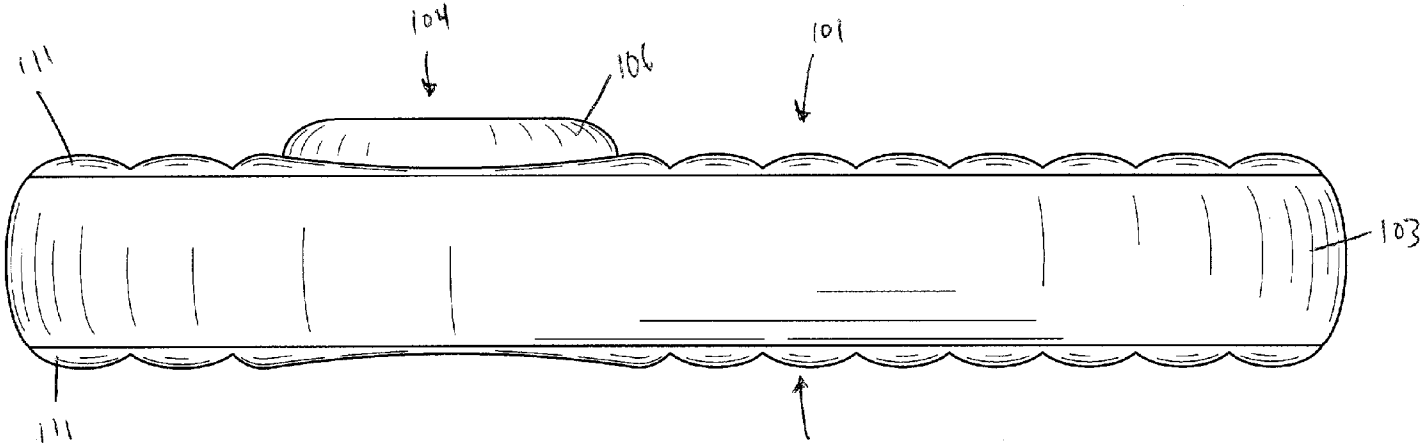
FIG. 49 is another side view of a seventh embodiment of the present invention.
Figure 50:
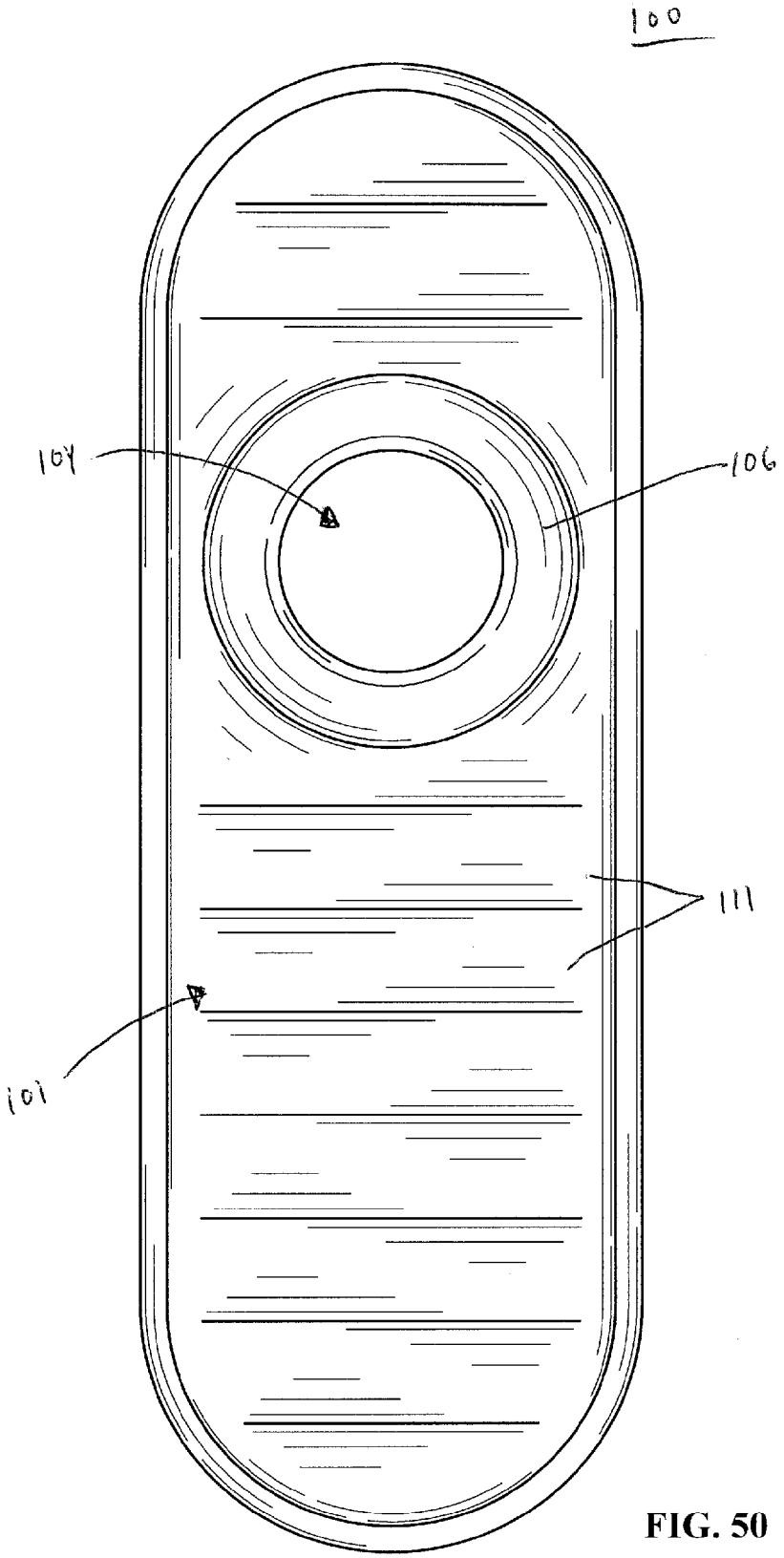
FIG. 50 is a top view of a seventh embodiment of the present invention.
Figure 51:
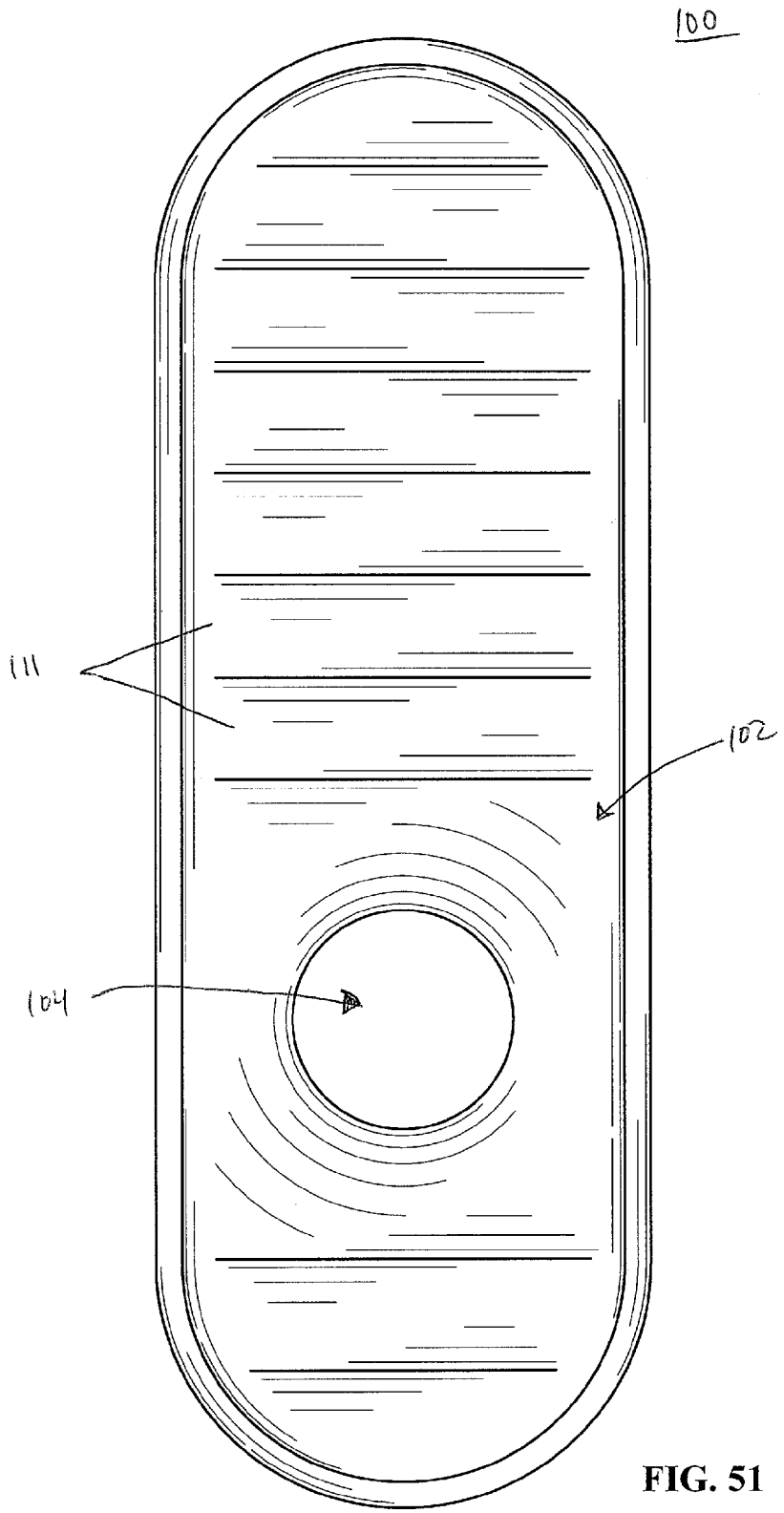
FIG. 51 is a bottom view of a seventh embodiment of the present invention.

FIGS. 24-30 refer to an embodiment similar to that shown in FIGS. 17-23, however, the embodiment shown in FIG. 24-30 has rounded ends (pill-shaped) when viewed from above (see FIGS. 29-30).

FIGS. 31-37 refer to an embodiment that has a top surface 101 that is substantially parallel to the bottom surface 102.

FIGS. 38-44 refer to an embodiment that has an abdominal opening 104 which is offset from the center of the support apparatus 100. Such a design takes into account that from the abdominal area most users will have less, in length, of an upper body, and a longer, in length, lower body. thus, such an embodiment may provide enhanced comfort during use by allowing a user to position themselves in a more desirable position upon the top surface 101. Further, the leg receiving area 108 is graded such that the legs of a user will rest below the pelvis of the user.

FIGS. 44-51 refers to a similar structural design as shown in FIGS. 38-44, however, this embodiment has a top surface 101 that is substantially parallel to the bottom surface 102.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A support apparatus comprising:

a top surface, a bottom surface, and at least one side surface together forming an inflatable chamber having a rounded first end and a rounded second end;

an abdominal opening extending from the top surface to the bottom surface, wherein the abdominal opening is formed by a second inflatable chamber with the second inflatable chamber being directly attached to the inflatable chamber, wherein the second inflatable chamber has a height greater than that of the top surface, and wherein the support apparatus is wider at the abdominal opening than at the head receiving area or the leg receiving area;

wherein the top surface forms a head receiving area and a leg receiving area;

wherein the head receiving area of the top surface is substantially parallel with the bottom surface, and wherein the leg receiving area of the top surface is graded such that a distance between the top surface and the bottom surface is greatest near the abdominal opening and narrowest near a terminal end of the leg receiving area;

wherein the head receiving area and the leg receiving area has ridges extending across a width thereof, and a distance of the top surface therebetween is devoid of the ridges;

wherein the leg receiving area is graded such that from about the abdominal opening to about the terminal end there is about an 8 inch decrease in height over about 36 inches in length;

wherein the support apparatus is configured to lift a pelvis of a user when the user lays in a prone position upon the support apparatus, wherein the support apparatus is wider at the abdominal opening than at the head receiving area or the leg receiving area, and wherein the support apparatus is tapered at the leg receiving area.

2. The support apparatus of claim 1 further comprising a covering configured to cover the top surface of the support apparatus.

3. The support apparatus of claim 2 wherein the covering has an opening configured to be positioned over the abdominal opening.

4. The support apparatus of claim 2 wherein the covering is coupled to the bottom surface of the support apparatus.

5. The support apparatus of claim 1 wherein an outer edge of the second inflatable chamber is located about 36 inches from a terminal end of the leg receiving.

6. The support apparatus of claim 1 wherein the second inflatable chamber is configured to be inflated such that an upper surface of the second inflatable chamber is about 1 inch to about 4 inches above the top surface of the support apparatus.

7. The support apparatus of claim 1 wherein the abdominal opening is about 18 inches in diameter.

8. A support apparatus comprising:

a top surface, a bottom surface, and at least one side surface forming an inflatable chamber having a rounded first end and a rounded second end;

an abdominal opening disposed at a maximum width of the inflatable chamber, the abdominal opening extending from the top surface to the bottom surface, wherein the abdominal opening is formed by a second inflatable chamber with the second inflatable chamber being directly attached to the inflatable chamber, and wherein the second inflatable chamber has a height greater than that of the top surface;

a covering configured to be coupled to the bottom surface of the support apparatus and cover the top surface and the at least one side surface, wherein the covering has an opening disposed at a location of the abdominal opening;

wherein the top surface forms a head receiving area and a lea receiving area;

wherein the leg receiving area is graded such that from the abdominal opening to the terminal end there is about an 8 inch decrease in height over about 36 inches in length, and wherein the support apparatus is tapered at the leg receiving area; and wherein the support apparatus is wider at the abdominal opening than at the head receiving area or the leg receiving area, and wherein each of the top surface and the bottom surface have a plurality of ridges longitudinally disposed thereon; and wherein the support apparatus is configured to lift a pelvis of a user when the user lays in a prone position upon the support apparatus.

9. The support apparatus of claim 8 wherein the abdominal opening is located in a center of a length of the support apparatus.

10. The support apparatus of claim 8 wherein an edge of the second inflatable chamber is located about 36 inches from a terminal end of the leg receiving.

11. The support apparatus of claim 8 wherein the second inflatable chamber is configured to be inflated such that an upper surface of the second inflatable chamber is about 1 inch to about 4 inches above the top surface of the support apparatus.

12. The support apparatus of claim 8 wherein the abdominal opening is about 18 inches in diameter.

* * * * *